US008029960B2

(12) United States Patent
Nagatomo et al.

(10) Patent No.: US 8,029,960 B2
(45) Date of Patent: Oct. 4, 2011

(54) TONER FOR DEVELOPING ELECTROSTATIC LATENT IMAGE, AND IMAGE FORMING APPARATUS AND PROCESS CARTRIDGE USING THE TONER

(75) Inventors: Tsuneyasu Nagatomo, Numazu (JP); Naohiro Watanabe, Shizuoka-ken (JP); Osamu Uchinokura, Mishima (JP); Satoshi Kojima, Numazu (JP)

(73) Assignee: Ricoh Company Limited, Tokyo (JP)

( * ) Notice: Subject to any disclaimer, the term of this patent is extended or adjusted under 35 U.S.C. 154(b) by 718 days.

(21) Appl. No.: 12/046,011

(22) Filed: Mar. 11, 2008

(65) Prior Publication Data

US 2008/0233505 A1 Sep. 25, 2008

(30) Foreign Application Priority Data

Mar. 19, 2007 (JP) ..... 2007-071442

(51) Int. Cl.
*G03G 5/04* (2006.01)

(52) U.S. Cl. ..... 430/108.6; 430/108.7; 430/118.8; 430/137.1

(58) Field of Classification Search ..... 430/108.6, 430/108.7
See application file for complete search history.

(56) References Cited

U.S. PATENT DOCUMENTS 5,827,632 A * 10/1998 Inaba et al. ..... 430/108.6
6,503,676 B2 1/2003 Yamashita et al.
6,733,939 B2 5/2004 Nanya et al.
6,846,604 B2 1/2005 Emoto et al.
6,849,369 B2 2/2005 Yagi et al.
6,852,462 B2 2/2005 Emoto et al.
6,855,468 B1 2/2005 Yamamoto et al.
6,936,390 B2 8/2005 Nanya et al.
7,056,635 B2 6/2006 Tanaka et al.
7,056,638 B1 6/2006 Tomita et al.
7,163,775 B2 1/2007 Takada et al.
7,208,256 B2 4/2007 Tanaka et al.
7,294,442 B2 11/2007 Takada et al.
(Continued)

FOREIGN PATENT DOCUMENTS

JP 3-100661 4/1991
(Continued)

OTHER PUBLICATIONS

U.S. Appl. No. 12/203,278, filed Sep. 3, 2008, Yamada et al.

*Primary Examiner* — Mark F Huff
*Assistant Examiner* — Jonathan Jelsma
(74) *Attorney, Agent, or Firm* — Oblon, Spivak, McClelland, Maier & Neustadt, L.L.P.

(57) ABSTRACT

A toner, including a parent particulate material including a colorant and a binder resin, and an external additive including particles having an average primary particle diameter from 80 to less than 150 nm in an amount of from 0.03 to 2% by number, particles having an average primary particle diameter from 5 nm to less than 15 nm in an amount of from 50 to 95% by number, and particles having an average primary particle diameter from 15 to less than 40 nm in an amount of from 5 to 40% by number, and the particles having an average primary particle diameter from 80 to less than 150 nm include particles having an average primary particle diameter not less than 200 nm in an amount of from 10 to 30% by number, and have a weight reduction rate not greater than 3.00% when heated from 30 to 250° C.

18 Claims, 7 Drawing Sheets

U.S. PATENT DOCUMENTS

| | | | | |
|---|---|---|---|---|
| 7,300,736 | B2 | 11/2007 | Fushimi et al. | |
| 7,303,847 | B2 | 12/2007 | Tomita et al. | |
| 7,306,887 | B2 | 12/2007 | Tanaka et al. | |
| 7,318,989 | B2 | 1/2008 | Kotsugai et al. | |
| 2004/0131961 | A1 | 7/2004 | Watanabe et al. | |
| 2005/0026089 | A1* | 2/2005 | Ogawa et al. | 430/405 |
| 2005/0031980 | A1 | 2/2005 | Inoue et al. | |
| 2005/0089786 | A1 | 4/2005 | Sugiura et al. | |
| 2005/0089787 | A1 | 4/2005 | Uchinokura et al. | |
| 2005/0164112 | A1 | 7/2005 | Ohki et al. | |
| 2005/0164114 | A1 | 7/2005 | Yagi et al. | |
| 2005/0208408 | A1 | 9/2005 | Uchinokura et al. | |
| 2006/0029433 | A1 | 2/2006 | Saito et al. | |
| 2006/0046174 | A1 | 3/2006 | Ohki et al. | |
| 2006/0057488 | A1 | 3/2006 | Inoue et al. | |
| 2006/0063081 | A1 | 3/2006 | Nagatomo et al. | |
| 2006/0063089 | A1 | 3/2006 | Tanaka et al. | |
| 2006/0068312 | A1 | 3/2006 | Yamashita et al. | |
| 2006/0099529 | A1 | 5/2006 | Tanaka et al. | |
| 2006/0160011 | A1 | 7/2006 | Inoue et al. | |
| 2006/0204883 | A1 | 9/2006 | Nakayama et al. | |
| 2006/0210903 | A1 | 9/2006 | Ohki et al. | |
| 2006/0240349 | A1 | 10/2006 | Watanabe et al. | |
| 2006/0251979 | A1 | 11/2006 | Watanabe et al. | |
| 2007/0031752 | A1 | 2/2007 | Watanabe et al. | |
| 2007/0042284 | A1* | 2/2007 | Takada et al. | 430/109.1 |
| 2007/0059626 | A1 | 3/2007 | Inoue et al. | |
| 2007/0141506 | A1 | 6/2007 | Inoue et al. | |
| 2007/0218383 | A1 | 9/2007 | Seshita et al. | |
| 2007/0218392 | A1 | 9/2007 | Yamada et al. | |
| 2007/0275315 | A1 | 11/2007 | Nagatomo et al. | |

FOREIGN PATENT DOCUMENTS

| | | |
|---|---|---|
| JP | 7-28276 | 1/1995 |
| JP | 9-319134 | 12/1997 |
| JP | 2001-13837 | 1/2001 |
| JP | 2001-66820 | 3/2001 |
| JP | 2002-196526 | 7/2002 |

* cited by examiner

TONER FOR DEVELOPING ELECTROSTATIC LATENT IMAGE, AND IMAGE FORMING APPARATUS AND PROCESS CARTRIDGE USING THE TONER

BACKGROUND OF THE INVENTION

1. Field of the Invention

The present invention relates to a toner for use in a developer for developing an electrostatic latent image in electrophotography, electrostatic recording, electrostatic printing, etc., and to an image forming apparatus and a process cartridge using the toner. More particularly to a toner for developing an electrostatic image for use in copiers, laser printers, plain paper facsimiles, etc. using direct or indirect electrophotographic developing method, an image forming apparatus and a process cartridge using the toner, and to a method of preparing the toner.

2. Discussion of the Background

Recent strong demands for higher quality images from the market spur development of suitable image forming apparatuses and a developer (toner) for use therein.

The toner for higher quality images needs to have a uniform particle diameter. This is because when a toner having a sharp particle diameter distribution, individual toner particles uniformly move to largely improve microscopic dot reproducibility.

However, it has conventionally been difficult to stably clean a toner having a small and uniform particle diameter, and particularly a blade cleaner is very difficult to clean the toner having a small and uniform particle diameter.

In this circumstance, various methods of designing a toner to improving the cleanability thereof are considered.

One of the methods is changing the shape of a toner from a sphere to an irregular shape. A toner having an irregular shape has low fluidity and is easily dammed by a cleaning blade. However, when the shape of a toner is too irregular, the toner irregularly behaves, resulting in deterioration of microscopic dot reproducibility.

As mentioned above, although the toner having an irregular shape has reliable cleanability, the toner is difficult to transfer.

In order to improve transferability and cleanability of a toner, Japanese published unexamined application No. 3-100661 discloses a toner including a specific amount of two inorganic particulate materials as external additives having an average particle diameter not less than 5 mμ and less than 20 mμ, and from 20 to 40 mμ, respectively. Although the toner initially has high transferability and cleanability, the external additives are easily buried or peeled, resulting in large deterioration of the transferability and cleanability.

Japanese published unexamined applications Nos. 7-28276 and 9-319134 disclose that an inorganic particulate material having a large particle diameter is effectively used to prevent them from being buried in a toner (colored particulate material). Having a large specific gravity, the inorganic particulate material having a large particle diameter does not adhere well to a toner and easily leaves therefrom, resulting in longer life of a cleaning blade.

It is thought that this is because the free inorganic particulate material having a large particle diameter between the blade edge and a photoreceptor forms an exquisite dam to largely decrease an abrasion therebetween. The present inventors are aware that an inorganic particulate material having a primary particle diameter not less than 200 nm is likely to leave from a toner and involved with forming the dam to maintain the cleanability. An inorganic particulate material having a primary particle diameter of from 80 to 200 nm has been conventionally said to prevent an external additive from being buried in a toner, and adheres on a toner to maintain the transferability.

The free inorganic particulate material having a large particle diameter is coated on a photoreceptor, resulting in filming thereover. Japanese published unexamined application No. 2001-66820 discloses the inorganic particulate material having a large particle diameter and an order of adding an external additive, but does not balance between forming the dam and preventing the filming. Particularly, the filming noticeably affects the resultant image quality at a high temperature and is desired to be higher technologically solved. Japanese published unexamined application No. 2001-13837 discloses a method of forming the dam, but needs an exclusive external additive applicator and is difficult to save space and cost. In addition, it is inconvenient that the external additive needs to be exchanged separately. Japanese published unexamined application No. 2002-196526 discloses specifying a particle diameter distribution of an external additive on the surface of a toner. Namely, the toner includes the external additive having a particle diameter of from 0.005 to 0.025 μm in an amount of 65 to 95% by weight, 0.025 to 0.080 μm in an amount of 4 to 35% by weight, and 0.080 to 0.500 μm in an amount of 0.3 to 10% by weight to prevent the external additive from being buried and produce high-definition images without contamination. However, the external additive having a particle diameter of from 0.080 to 0.500 μm, which is likely to leave from the toner, is not mentioned and an action against the filming over a photoreceptor is not fully performed.

Because of these reasons, a need exists for a toner for developing electrostatic latent images, having high cleanability, transferability with less untransferred toner and filming resistance, and stably producing high-quality images having good microscopic dot reproducibility even at a high temperature and/or a high humidity.

SUMMARY OF THE INVENTION

Accordingly, an object of the present invention is to provide a toner for developing electrostatic latent images, having high cleanability, transferability with less untransferred toner and filming resistance, and stably producing high-quality images having good microscopic dot reproducibility even at a high temperature and/or a high humidity.

Another object of the present invention is to provide an image forming apparatus using the toner.

A further object of the present invention is to provide a process cartridge using the toner.

Another object of the present invention is to provide a method of stably preparing the toner at low cost and high yield.

These objects and other objects of the present invention, either individually or collectively, have been satisfied by the discovery of a toner for developing electrostatic latent images, comprising:

a parent particulate material, comprising:

a colorant, and a binder resin; and an external additive, wherein the external additive comprises particles having an average primary particle diameter not less than 80 and less than 150 nm in an amount of from 0.03 to 2% by number, particles having an average primary particle diameter not less than 5 nm and less than 15 nm in an amount of from 50 to 95% by number, and particles having an average primary particle diameter not less than 15 and less than 40 nm in an amount of from 5 to 40% by number, and wherein the particles having an average primary particle diameter not less than 80 and less than 150 nm comprises particles having an average primary particle diameter not less than 200 nm in an amount of from 10 to 30% by number, and have a weight reduction rate not greater than 3.00% when heated from 30 to 250° C.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
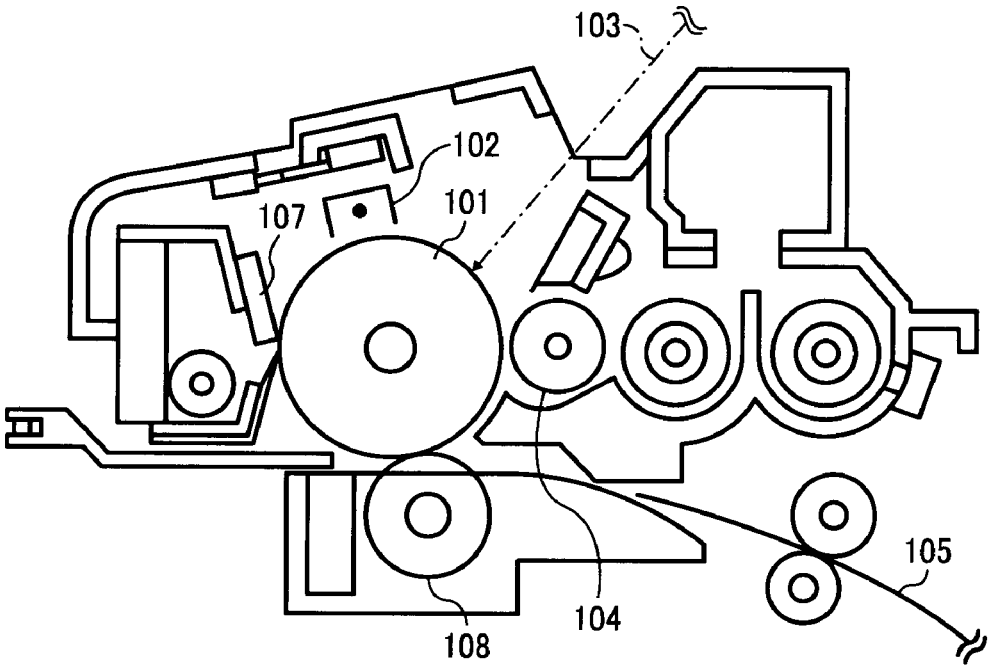
FIG. 1 is a schematic view illustrating an embodiment of the process cartridge of the present invention.

The present invention provides a toner for developing electrostatic latent images, having high cleanability, transferability with less untransferred toner and filming resistance, and stably producing high-quality images having good microscopic dot reproducibility even at a high temperature and/or a high humidity. More particularly, the present invention relates to a toner for developing electrostatic latent images, comprising:

a parent particulate material, comprising:

a colorant, and a binder resin; and an external additive, wherein the external additive comprises particles having an average primary particle diameter not less than 80 and less than 150 nm in an amount of from 0.03 to 2% by number, particles having an average primary particle diameter not less than 5 nm and less than 15 nm in an amount of from 50 to 95% by number, and particles having an average primary particle diameter not less than 15 and less than 40 nm in an amount of from 5 to 40% by number, and wherein the particles having an average primary particle diameter not less than 80 and less than 150 nm comprises particles having an average primary particle diameter not less than 200 nm in an amount of from 10 to 30% by number, and have a weight reduction rate not greater than 3.00% when heated from 30 to 250° C.

The particles having an average primary particle diameter not less than 200 nm release from a toner to form an exquisite dam between an electrostatic latent image bearer (hereinafter referred to as a photoreceptor) and a cleaning blade edge. The dam works as a buffer layer preventing a toner from hitting the blade and a lubricant decreasing an abrasion between the cleaning blade and the photoreceptor), which largely improves the cleanability of the toner.

The above-mentioned weight reduction rate is more preferably not greater than 2.00%, and furthermore preferably not greater than 1.00%.

The dam-forming particles having an average primary particle diameter not less than 200 nm and a weight reduction rate not greater than 3.00% when heated from 30 to 250° C. are difficult to adhere on the photoreceptor and difficult to appear on images even when adhering thereon. This is more effective at a high humidity. When the weight reduction rate is greater than 3.00%, the filming resistance largely deteriorates.

The particles having an average primary particle diameter not less than 80 and less than 150 nm more preferably include particles having an average primary particle diameter not less than 200 nm in an amount of from 12 to 28% by number, and furthermore preferably from 15 to 25% by number.

When less than 10% by number, the dam layer is not fully formed, resulting in inability of maintaining cleanability. When greater than 30% by number, the external additive leaves a toner too much, resulting in large deterioration of the filming resistance and unstable transferability.

The particles having an average primary particle diameter not less than 80 nm and less than 200 nm are difficult to leave a toner and reduces burial of the external additive due to an external stress in an image developer as a spacer between the toner and the photoreceptor. Therefore, the toner has a stable transferability for a long time.

The particles having an average primary particle diameter less than 80 nm efficiently gives fluidity to a toner, and largely improves feedability and transportability thereof. Even a small amount thereof exerts a large effect.

The external additive more preferably includes particles having an average primary particle diameter not less than 5 nm and less than 15 nm in an amount of from 60 to 90% by number, and furthermore preferably from 70 to 85% by number.

The above-mentioned constitutions efficiently perform all of the cleanability, transferability and filming resistance.

The external additive for use in the toner of the present invention in characterized by being surface-treated (hydrophobized) with a silicone oil, a silicone coupling agent, a titanium coupling agent or an aluminum coupling agent.

When a toner is mixed with an external additive which is surface-treated with a coupling agent while hydrolyzed, the toner is not easily influenced by an environment such as a temperature and a humidity.

The external additive can be hydrophobized with a silicone oil, a silicone coupling agent, a titanium coupling agent or an aluminum coupling agent by a combustion method, etc. at a high temperature.

Methods of externally adding an external additive such as a monodispersed spherical silica includes known methods using various mixers such as V-type blender, Henschel Mixer and Mechanofusion. In the present invention, the external additive can be dispersed in an aqueous medium so as to adhere to a toner.

The number and a particle diameter of an external additive on the surface of a toner can be measured by photographing with a field-effect scanning electron microscope JSM6400F at an accelerating voltage of 5 kV and a magnification of 40,000 times and optionally with an image analyzer.

The weight reduction rate of the external additive having an average primary particle diameter not less than 80 and less than 150 nm when heated from 30 to 250° C. can be independently measured by a DTA-Tg measurer such as DTG-60 from Shimadzu Corp.

The toner of the present invention preferably has a ratio (Dv/Dn) of a volume-average particle diameter (Dv) thereof to a number-average particle diameter thereof (Dn) of from 1.10 to 1.30 to produce high-resolution and high-quality images. Further, in a two-component developer, the toner has less variation in the particle diameter even after consumed and fed for long periods, and has good and stable developability even after stirred in an image developer for long periods. When Dv/Dn is greater than 1.30, the particle diameter distribution of the toner becomes flat, resulting in deterioration of reproducibility of a microscopic dot. The toner more preferably has Dv/Dn of from 1.00 to 1.20 to produce better quality images.

The toner of the present invention preferably has a volume-average particle diameter (Dv) of from 3.0 to 7.0 μm. Typically, it is said that the smaller the toner particle diameter, the more advantageous to produce high resolution and quality images. However, the small particle diameter of the toner is disadvantageous thereto to have transferability and cleanability. When the volume-average particle diameter is too small, the resultant toner in a two-component developer melts and adheres to a surface of a carrier to deteriorate chargeability thereof when stirred for long periods in an image developer. When the toner is used in a one-component developer, toner filming over a developing roller and fusion bond of the toner to a blade forming a thin layer thereof tend to occur. This largely depends on a content of a fine powder. When the toner includes particles having a diameter not greater than 2 μm in an amount greater than 20% by number, the toner is likely to adhere to a carrier and have poor charge stability. When the average particle diameter is larger than the scope of the present invention, the resultant toner has a difficulty in producing high resolution and quality images. In addition, the resultant toner has a large variation of the particle diameters in many cases after the toner in a developer is consumed and fed for long periods. When Dv/Dn is greater than 1.30, the results are same.

The toner of the present invention preferably has an average circularity of from 0.925 to 0.970, and more preferably from 0.945 to 0.965. A peripheral length of a circle having an area equivalent to that of a projected image optically detected is divided by an actual peripheral length of the toner particle to determine the circularity of a toner. The toner preferably includes particles having a circularity less than 0.925 in an amount not greater than 15%. A toner having an average circularity less than 0.925 is likely not to have a satisfactory transferability and produce high-quality images without scattering. When the toner has an average circularity greater than 0.970, a photoreceptor and a transfer belt in an apparatus using a cleaning blade are poorly cleaned, resulting in occasional production of contaminated images. When an image having a large image area, an untransferred residual toner due to defective paper feeding is accumulated on the photoreceptor, resulting in production of images having background fouling. Further, a contact charger such as a charging roller charging a photoreceptor while contacting thereto is contaminated, resulting in having poor chargeability.

As mentioned above, the toner preferably includes particles having a circularity not greater than 0.950 in an amount of from 20 to 80% by number because toner particles having a uniform and small particle diameter are difficult to stably clean.

A relationship between the shape and transferability of a toner will be explained. Only a conventional amorphous toner is difficult to improve the transferability in a full-color copier wherein multicolor development and transfer are performed is because an amount of the toner on a photoreceptor increases compared with a unicolor black toner for used in a monochrome copier. Further, when a conventional toner is used, toner is likely to be fusion-bonded to or filming over the surface of a photoreceptor or an intermediate transferer due to scrapes or frictions between a photoreceptor and a cleaning member, an intermediate transferer and a cleaning member and/or a photoreceptor and an intermediate transferee, resulting in deterioration of the transferability. Four color toner images are difficult to uniformly transfer in full-color image formation. Further, when an intermediate transferer is used, color uniformity and balance are likely to have problems and high-quality full-color images are not easy to stably produce.

A toner including particles having a circularity not greater than 0.950 in an amount of from 20 to 80% by number has both good blade cleanability and transferability. The blade cleaning and transferability largely depends on a material of the blade and how to contact the blade to a photoreceptor as well. When the toner includes particles having a circularity not greater than 0.950 in an amount less than 20% by number, the blade cleaning becomes difficult. When the toner includes particles having a circularity not greater than 0.950 in an amount greater than 80% by number, the transferability deteriorates. This is because the toner is so deformed that the toner does not smoothly transfer between the surface of a photoreceptor and a transfer paper, the surface of a photoreceptor and an intermediate transferer, a first intermediate transferer and a second intermediate transferer, etc., and toner particles unevenly transfer, resulting in nonuniform and low transferability. Besides, the toner is unstably charged and fragile. Further, the toner becomes a fine powder in a developer, resulting in deterioration of durability of the developer.

Further, a toner preferably includes particles having a circularity less than 0.925 in an amount not greater than 15% by number.

The content of the toner particles having a diameter not greater than 2 μm and the circularity of the toner is measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

The average particle diameter and particle diameter distribution of the toner can be measured by a Coulter counter TA-II or Coulter Multisizer II from Beckman Coulter, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

In the present invention, an Interface producing a number distribution and a volume distribution from Nikkaki Bios Co., Ltd. and a personal computer PC9801 from NEC Corp. are connected with the Coulter Multisizer II to measure the average particle diameter and particle diameter distribution.

Further in the present invention, THF-soluble components of a polyester resin included in the binder resin preferably have a weight-average molecular weight of from 1,000 to 30,000 to prepare a toner maintaining heat-resistant preservability, effectively exerting low-temperature fixability and having offset resistance. When less than 1,000, the heat-resistant preservability deteriorates because an oligomer components increase. When greater than 30,000, the offset resistance deteriorates because the polyester resin is not sufficiently modified due to a steric hindrance.

In the present invention, molecular weight is measured by GPC (gel permeation chromatography) as follows. A column is stabilized in a heat chamber having a temperature of 40° C.; THF is put into the column at a speed of 1 ml/min as a solvent; 50 to 200 μl of a THF liquid-solution of a resin, having a sample concentration of from 0.05 to 0.6% by weight, is put into the column; and a molecular weight distribution of the sample is determined by using a calibration curve which is previously prepared using several polystyrene standard samples having a single distribution peak, and which shows the relationship between a count number and the molecular weight. As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

A first binder resin in the toner of the present invention is preferably a resin having a polyester skeleton, specifically a polyester resin. When the first binder resin has an acid value of from 1.0 to 50.0 KOH mg/g, a basic compound is capably added to the toner to enhance the toner properties such as particle diameter controllability, low-temperature fixability, hot offset resistance, heat-resistant preservability and charge stability. Namely, when the acid value is greater than 50.0 KOHmg/g, an elongation or a cross-linking reaction of the binder resin precursor insufficiently performed, resulting in poor hot offset resistance. When less than 1.0 KOHmg/g, a basic compound does not stabilize the dispersion of the binder resin and an elongation or a cross-linking reaction of a modified polyester is likely to perform, i.e., the toner is not stably prepared. The acid value of the resin is measured by the method mentioned in JIS K0070-1992.

0.5 g of polyester is stirred in 120 ml of THF at a room temperature (23° C.) for 10 hrs to be dissolved therein, and 30 ml of ethanol is further added thereto to prepare a sample solution.

The following device is used to measure the acid value, and which is specifically determined as follows.

A N/10 caustic potassium-alcohol solution is titrated in the sample solution and the acid value is determined form a consumed amount of the caustic potassium-alcohol solution using the following formula:

Acid value=KOH (ml)×N×56.1/weight of the sample solution wherein N is N/10 KOH factor.

The acid value of the polyester resin for use in the present invention is measured by the following method based on JIS K0070, using a mixed a solvent including 120 ml of toluene and 30 ml of ethanol.

The acid value is specifically decided by the following procedure.

| | |
|---|---|
| Measurer: | potentiometric automatic titrator DL-53 Titrator from Metler-Toledo Limited |
| Electrode: | DG113-SC from Metler-Toledo Limited |
| Analysis software: | LabX Light Version 1.00.000 |
| Temperature: | 23° C. |

The measurement conditions are as follows:

| Stir | |
|---|---|
| Speed[%] | 25 |
| Time[s] | 15 |
| EQP titration Titrant/Sensot | |
| Titrant | CH30Na |
| Concentration[mol/L] | 0.1 |
| Sensor | DG115 |
| Unit of measurement | mV |
| Predispensing to volume | |
| Volume [ml] | 1.0 |
| Wait time [s] | 0 |
| Titrant addition | Dynamic |
| dE(set) [mV] | 8.0 |
| dV(min) [mL] | 0.03 |
| dV(max) [mL] | 0.5 |
| Measure mode | Equilibrium controlled |
| dE [mV] | 0.5 |
| dt [s] | 1.0 |
| t(min) [s] | 2.0 |
| t(max) [s] | 20.0 |
| Recognition | |
| Threshold | 100.0 |
| Steepest jump only | No |
| Range | No |
| Tendency | None |
| Termination | |
| at maximum volume [mL] | 10.0 |
| at potential | No |
| at slope | No |
| after number EQPs n = 1 | Yes |
| comb. Termination conditions | No |

-continued

| Evaluation | |
|---|---|
| Procedure | Standard |
| Potential 1 | No |
| Potential 2 | No |
| Step for reevaluation | No |

In the present invention, heat-resistant preservability of main components of a polyester resin after modified, i.e., a binder resin depends on a glass transition temperature of the polyester resin before modified, and a first binder resin preferably has a glass transition temperature of from 35 to 65° C. When less than 35° C., the heat-resistant preservability is insufficient. When greater than 65° C., the low-temperature fixability deteriorates.

In the present invention, the glass transition temperature (Tg) is measured by TG-DSC system TAS-100 from RIGAKU Corp. at a programming rate of 10° C./min.

First, about 10 mg of a sample in an aluminum container was loaded on a holder unit, which was set in an electric oven. After the sample was heated in the oven at from a room temperature to 150° C. and a programming speed of 10° C./min, the sample was left for 10 min at 150° C. After the samples was cooled to have a room temperature and left for 10 min, the sample was heated again in a nitrogen environment to have a temperature of 150° C. at a programming speed of 10° C./min and DSC measurement of the sample was performed. Tg was determined from a contact point between a tangent of a heat absorption curve close to Tg and base line using an analyzer in TAS-100.

In the present invention, the binder resin precursor resin is essential to realize low-temperature fixability and hot offset resistance of the resultant toner, and preferably has a weight-average molecular weight of from 3,000 to 20,000. When less than 3,000, the reaction speed is difficult to control and the production stability deteriorates. When greater than 20,000, a polyester sufficiently modified cannot be obtained and offset resistance of the resultant toner deteriorates.

In the present invention, an acid value of a toner is more essential index than that of a binder resin for low-temperature fixability and hot offset resistance of the resultant toner. An acid value of the toner of the present invention comes from an end carboxyl group of an unmodified polyester resin. The toner preferably has an acid value of form 0.5 to 40.0 (KOH mg/g) to control low-temperature fixability such as minimum fixable temperature and hot offset generation temperature of the resultant toner. When greater than 40.0 (mg KOH/g), an elongation or a cross-linking reaction of a modified polyester is not sufficient and the hot offset resistance of the resultant toner deteriorates. When less than 0.5 (mg KOH/g), a basic compound does not stabilize the dispersion of the binder resin and an elongation or a cross-linking reaction of a modified polyester is likely to perform, i.e., the toner is not stably prepared.

The acid value of the toner is specifically determined according to the method of measuring the acid value of the polyester resin. When the toner includes THF-insoluble components, the acid value thereof is measured using THF as a solvent.

The acid value of the toner is measured by the method mentioned in JIS K0070-1992, using 0.5 g (0.3 g when ethylacetate-soluble components are included in the toner) of the toner instead of the polyester resin.

The toner of the present invention preferably has a glass transition temperature of from 40 to 70° C. to have low-temperature fixability, high-temperature offset resistance and high durability. When less than 40° C., toner blocking in an image developer and filming over a photoreceptor tend to occur. When greater than 70° C., the low-temperature fixability of the resultant toner deteriorates.

The toner of the present invention is prepared by dissolving or dispersing a toner constituent including at least a binder component formed of a modified polyester resin reactable with an active hydrogen atom and a colorant in an organic solvent to form a solution or a dispersion; reacting the solution or dispersion with a crosslinker and/or an elongator in an aqueous medium including a dispersant to prepare a second dispersion; and removing the solvent from the second dispersion.

Specific examples of the modified polyester resin reactable with an active hydrogen atom include a polyester polymer (A) having an isocyanate group. Specific examples of the prepolymer (A) include a polymer formed from a reaction between polyester having an active hydrogen atom formed by polycondensation between polyol (PO) and a polycarboxylic acid, and polyisocyanate (PIC). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

Amines are used as a crosslinker for the reactive modified polyester resin, and diisocyanate compounds such as diphenylmethanediisocyanate are used as an elongator therefor. The amines mentioned in detail later work as a crosslinker or an elongator for the modified polyester resin reactable with an active hydrogen.

The modified polyester such as a urea-modified polyester formed from a reaction between the polyester prepolymer having an isocyanate group (A) and an amine (B) is easy to control molecular weight of the high molecular weight component, and preferably used for an oilless low-temperature fixing method (without an release oil applicator for a heating medium for fixation). Particularly, the polyester prepolymer having a urea-modified end can prevent adherence to the heating medium for fixation while maintaining high fluidity and transparency of an unmodified polyester resin in a range of fixing temperature.

The polyester prepolymer for use in the present invention is preferably a polyester having at its end an acid radical or a hydroxyl group including an active hydrogen to which a functional group such as an isocyanate group is introduced. A modified polyester such as a urea-modified polyester can be introduced from the prepolymer. However, in the present invention, the modified polyester used as a toner binder is preferably a urea-modified polyester formed from a reaction between the polyester prepolymer having an isocyanate group (A) and the amine (B) used as a crosslinker and/or an elongation agent. The polyester prepolymer (A) can be formed from a reaction between polyester having an active hydrogen atom formed by polycondensation between polyol (PO) and a polycarboxylic acid, and polyisocyanate (PIC). Specific examples of the groups including the active hydrogen include a hydroxyl group (an alcoholic hydroxyl group and a phenolic hydroxyl group), an amino group, a carboxyl group, a mercapto group, etc. In particular, the alcoholic hydroxyl group is preferably used.

As the polyol (PO), diol (DIO) and polyol having 3 valences or more (TO) can be used, and DIO alone or a mixture of DIO and a small amount of TO is preferably used. Specific examples of DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkyleneoxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarboxylic acid (PC), dicarboxylic acid (DIC) and polycarboxylic acid having 3 or more valences (TC) can be used. DIC alone, or a mixture of DIC and a small amount of TC are preferably used. Specific examples of DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester. PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as α, α, α', α'-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates. The content of the constitutional component of a polyisocyanate in the polyester prepolymer (A) having a polyisocyanate group at its end portion is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), aminomercaptans (B4), aminoacids (B5) and blocked amines (B6) in which the amines (B1-B5) mentioned above are blocked. Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The molecular weight of the urea-modified polyesters can optionally be controlled using an elongation anticatalyst, if desired. Specific examples of the elongation anticatalyst include monoamines such as diethyle amine, dibutyl amine, butyl amine and lauryl amine, and blocked amines, i.e., ketimine compounds prepared by blocking the monoamines mentioned above.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than ½, molecular weight of the urea-modified polyester decreases, resulting in deterioration of hot offset resistance of the resultant toner.

A polyester resin preferably used in the present invention is a urea-modified polyester (UMPE), and the UMPE may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The modified polyester such as the UMPE can be produced by a method such as a one-shot method. The weight-average molecular weight of the modified polyester of the UMPE is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the modified polyester of the UMPE is not particularly limited when the after-mentioned an unmodified polyester resin (PE) is used in combination.

Namely, the weight-average molecular weight of the UMPE resins has priority over the number-average molecular weight thereof. However, when the UMPE is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

In the present invention, not only the modified polyester of the UMPE alone but also the PE can be included as a toner binder with the UMPE. A combination thereof improves low temperature fixability of the resultant toner and glossiness of color images produced thereby, and the combination is more preferably used than using the UMPE alone. Suitable PE includes polycondensation products of PO and PC similarly to the UMPE and specific examples of the PE are the same as those of the UMPE. The PE preferably has a weight-average particle diameter (Mw) of from 10,000 to 300,000, and more preferably from 14,000 to 200,000. In addition, the PE preferably has a number-average particle diameter of from 1,000 to 10,000, and more preferably from 1,500 to 6,000. In addition, for the UMPE, not only the unmodified polyester but also polyester resins modified by a bonding such as urethane bonding other than a urea bonding, can also be used together. It is preferable that the UMPE at least partially mixes with the PE to improve the low temperature fixability and hot offset resistance of the resultant toner. Therefore, the UMPE preferably has a structure similar to that of the PE. A mixing ratio (UMPE/PE) between the UMPE and PE is from 5/95 to 80/20, preferably from 5/95 to 30/70, more preferably from 5/95 to 25/75, and even more preferably from 7/93 to 20/80. When the UMPE is less than 5%, the hot offset resistance deteriorates, and in addition, it is disadvantageous to have both high temperature preservability and low temperature fixability.

The PE preferably has a hydroxyl value not less than 5 mg KOH/g and an acid value of from 1 to 30 mg KOH/g, and more preferably from 5 to 20 mg KOH/g. Such PE tends to be negatively charged, and the resultant toner has good affinity with a paper and low temperature fixability thereof is improved. However, when the acid value is greater than 30 mg KOH/g, chargeability of the resultant toner deteriorates particularly due to an environmental variation. In a polyaddition reaction, a variation of the acid value causes a crush of particles in a granulation process and it is difficult to control emulsifying.

The hydroxyl value is measured similarly to the method of measuring the acid value.

Precisely-weighed 0.5 g of a sample is placed in a volumetric flask, and precisely-measured 5 ml of an acetylated reagent is added thereto to prepare a mixture. The mixture is heated whiled dipped in an oil bath having a temperature at 100±5° C. One to two hrs later, the flask is taken out of the oil bath and left to cool. Water is added to the mixture, and the mixture is shaken to breakdown an acetic anhydride. The flask is heated again in an oil bath to complete the breakdown for not less than 10 min. After left and cooled, the inner wall of the flask is washed with an organic solvent. The mixture is subjected to a potentiometric titration with a N/2 potassium hydroxide ethyl alcohol solution using the above-mentioned electrode according to JIS K0070-1966.

In the present invention, the toner binder preferably has a glass transition temperature (Tg) of from 40 to 70° C., and preferably from 40 to 60° C. When the glass transition temperature is less than 40° C., the heat resistance of the toner deteriorates. When higher than 70° C., the low temperature fixability deteriorates. Because of a combination of the modified polyester such as UMPE and PE, the toner of the present invention has better heat-resistant preservability than known toners including a polyester resin as a binder resin even though the glass transition temperature is low.

A wax for use in the toner of the present invention has a low melting point of from 50 to 120° C. When such a wax is included in the toner, the wax is dispersed in the binder resin and serves as a release agent at a location between a fixing roller and the toner particles. Thereby, hot offset resistance can be improved without applying an oil to the fixing roller used.

In the present invention, the melting point of the wax is a maximum heat absorption peak measured by a differential scanning calorimeter (DSC).

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

Specific examples of the colorant for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, ChromeGreen, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight. The colorant for use in the present invention can be used as a masterbatch pigment when combined with a resin.

Specific examples of the resin for use in the masterbatch pigment or for use in combination with masterbatch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The masterbatch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three-roll mill is preferably used for kneading the mixture upon application of high shear stress.

In the present invention, a charge controlling agent is fixed on the surface of the toner particles, for example, by the following method. Toner particles including at least a resin and a colorant are mixed with particles of a release agent in a container using a rotor. In this case, it is preferable that the container does not have a portion projected from the inside surface of the container, and the peripheral velocity of the rotor is preferably from 40 to 150 m/sec.

The toner of the present invention may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images. These charge controlling agent and release agent can be kneaded together with a masterbatch pigment and resin. In addition, the charge controlling agent and release agent can be added when such toner constituents are dissolved or dispersed in an organic solvent.

The toner binder of the present invention can be prepared, for example, by the following method. The polyol (PO) and the polycarboxylic acid (PC) are heated at a temperature of from 150 to 280° C. in the presence of a known catalyst such as tetrabutoxy titanate and dibutyltinoxide. Then, water generated is removed, under a reduced pressure if desired, to prepare a polyester resin having a hydroxyl group. Then the polyester resin is reacted with polyisocyanate (PIC) at a temperature of from 40 to 140° C. to prepare a prepolymer (A) having an isocyanate group. Further, the prepolymer (A) is reacted with an amine (B) at a temperature of from 0 to 140° C. to prepare a urea-modified polyester (UMPE) The UMPE has a number-average molecular weight of from 1,000 to 10,000, and preferably from 1,500 to 6,000. When polyisocyanate, and A and B are reacted, a solvent can be used if desired. Suitable solvents include solvents which do not react with polyisocyanate (PIC). Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran. When polyester which does not have a urea bonding (PE) is used in combination with the urea-modified polyester, a method similar to a method for preparing a polyester resin having a hydroxyl group is used to prepare the polyester which does not have a urea bonding, and the polyester which does not have a urea bonding is dissolved and mixed in a solution after a reaction of the UMPE is completed.

The toner of the present invention can be prepared by the following method, but the method is not limited thereto.

The aqueous medium for use in the present invention includes water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

The toner of the present invention can be prepared by reacting a dispersion formed of the prepolymer (A) having an isocyanate group with (B). As a method of stably preparing a dispersion formed of the urea-modified polyester or the prepolymer (A) in an aqueous medium, a method of including toner constituents such as the urea-modified polyester or the prepolymer (A) into an aqueous medium and dispersing them upon application of shear stress is preferably used. The prepolymer (A) and other toner constituents such as colorants, master batch pigments, release agents, charge controlling agents, unmodified polyester resins, etc. may be added into an aqueous medium at the same time when the dispersion is prepared. However, it is preferable that the toner constituents are previously mixed and then the mixed toner constituents are added to the aqueous liquid at the same time. In addition, colorants, release agents, charge controlling agents, etc., are not necessarily added to the aqueous dispersion before particles are formed, and may be added thereto after particles are prepared in the aqueous medium. A method of dyeing particles previously formed without a colorant by a known dying method can also be used.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C. When the temperature is relatively high, the urea-modified polyester or prepolymer (A) can easily be dispersed because the dispersion formed thereof has a low viscosity.

The content of the aqueous medium to 100 parts by weight of the toner constituents including the urea-modified polyester or prepolymer (A) is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant mother toner particles do not have a desired particle diameter. In contrast, when the content is greater than 2,000, the production cost increases. A dispersant can preferably be used to prepare a stably dispersed dispersion including particles having a sharp particle diameter distribution.

Specific examples of the dispersants used to emulsify and disperse an oil phase for a liquid including water in which the toner constituents are dispersed include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle) glycin, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium-{omega-fluoroalkanoyl(C6-C8)-N-ethylamino}-1-propane sulfonate, fluoroalkyl(C11-C20) carboxylic acids and their metal salts, perfluoroalkylcarboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compound dispersants such as tricalcium phosphate, calcium carbonate, titanium oxide, colloidal silica and hydroxyapatite which are hardly insoluble in water can also be used.

In addition, particulate polymers can also be used as a dispersant as well as inorganic dispersants such as calcium phosphate, sodium carbonate and sodium sulfate. Specific examples of the particulate polymers include particulate polymethyl methacrylate having a particle diameter of 1 μm and 3 μm, particulate polystyrene having a particle diameter of 0.5 μm and 2 μm, particulate styrene-acrylonitrile copolymers having a particle diameter of 1 μm, PB-200H (from Kao Corp.), SGP (Soken Chemical & Engineering Co., Ltd.), TECHNOPOLYMER SB (Sekisui Plastics Co., Ltd.), SPG-3G (Soken Chemical & Engineering Co., Ltd.), and MICROPEARL (Sekisui Fine Chemical Co., Ltd.).

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The prepared emulsion dispersion (reactant) is gradually heated while stirred in a laminar flow, and an organic solvent is removed from the dispersion after stirred strongly when the dispersion has a specific temperature to from a toner particle having a shape of spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

When a dispersant is used, the dispersant may remain on a surface of the toner particle.

Further, in order to decrease viscosity of a dispersion medium including the toner constituents, a solvent which can dissolve the UMPE or prepolymer (A) can be used because the resultant particles have a sharp particle diameter distribution.

The solvent is preferably volatile and has a boiling point lower than 100° C. because of easily removed from the dispersion after the particles are formed. Specific examples of such a solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. The addition quantity of such a solvent is from 0 to 300 parts by weight, preferably from 0 to 100, and more preferably from 25 to 70 parts by weight, per 100 parts by weight of the prepolymer (A) used. When such a solvent is used to prepare a particle dispersion, the solvent is removed therefrom under a normal or reduced pressure after the particles are subjected to an elongation reaction and/or a crosslinking reaction of the modified polyester (prepolymer) with amine.

The elongation and/or crosslinking reaction time depend on reactivity of an isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

In the present invention, a solvent is preferably removed from the dispersion liquid after the elongation and/or crosslinking reaction at 10 to 50° C. after it is strongly stirred at a specific temperature lower than the glass transition temperature of the resin and an organic solvent concentration to form and see particles, which deforms the toner. This is not an absolute condition and the condition has to be properly controlled. When an organic solvent concentration is high in granulating, the viscosity of the emulsion decreases and the particles are likely to have the shape of a sphere. When low, the viscosity thereof is high and the particles have shapes out of specification. Therefore, the condition has to be optimally controlled, and which controls the shape of a toner. Further, the content of the modified layered inorganic mineral controls the shape of a toner. The modified layered inorganic mineral is preferably included in a solution or a dispersion in an amount of from 0.05 to 10% by weight. When less than 0.05% by weight, the oil phase does not have a desired viscosity and the particles do not have desired shapes. In addition, the viscosity of the droplet decreases and the particles are likely to have the shape of a sphere. When greater than 10% by weight, the viscosity of the droplet is so high that particles are not formed.

On the other hand, a ratio (Dv/Dn) between a volume-average particle diameter (Dv) and a number-average particle diameter (Dn) of the toner can be fixed by controlling a water layer viscosity, an oil layer viscosity, properties of resin particles, addition quantity thereof, etc. In addition, Dv and Dn can be fixed by controlling the properties of resin particles, addition quantity thereof, etc.

The toner of the present invention can be used for a two-component developer in which the toner is mixed with a magnetic carrier. A content of the toner is preferably from 1 to 10 parts by weight per 100 parts by weight of the carrier. Suitable carriers for use in the two-component developer include known carrier materials such as iron powders, ferrite powders, magnetite powders, magnetic resin carriers, which have a particle diameter of from about 20 to 200 μm. A surface of the carrier may be coated by a resin. Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins. An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic developer or a one-component non-magnetic developer.

The process cartridge of the present invention includes at least an image bearer bearing an electrostatic latent image and an image developer developing the electrostatic latent image borne by the image bearer with a developer to form a visible image, and further includes other means optionally, such as a charger, a transferee, a cleaner, a discharger. The image developer at least contains the developer of the present invention and a developer bearer bearing and transferring the developer contained therein, and optionally includes a layer regulator regulating a toner layer borne on the surface of the developer bearer.

The process cartridge of the present invention is detachably installable in various electrophotographic image forming apparatuses, facsimiles and printers, and is preferably installed in the image forming apparatus detachably.

The process cartridge includes, as shown in FIG. 1, a photoreceptor 101 as an electrostatic latent image bearer and at least one of a charger 102, an irradiator 103, an image developer 104, a cleaner 107 and optional other means.

Known photoreceptors can be used as the photoreceptor 101, and details will be mentioned later.

Known chargers can be used as the charger 102.

The irradiator 103 uses a light source capable of writing a high-resolution electrostatic latent image.

The image forming apparatus of the present invention may include the electrostatic latent image bearer and at least one of components such as an image developer and a cleaner as a process cartridge in a body, which is detachable therefrom. Alternatively, a process cartridge including the electrostatic latent image bearer and at least one of a charger, an irradiator, an image developer, a transferer or separator, and a cleaner may be detachable from the image forming apparatus through a guide rail or the like.

The image forming apparatus of the present invention includes at least an electrostatic latent image former, an image developer, a transferer, a fixer and other optional means such as a discharger, a cleaner, a recycler and a controller.

An image forming method performed by the image forming apparatus of the present invention includes at least an electrostatic latent image forming process, a development process, a transfer process and a fixing process; and optionally includes other processes such as a discharge process, a cleaning process, a recycle process and a control process.

The electrostatic latent image forming process is performed by the electrostatic latent image former. The development process is performed by the image developer. The transfer process is performed by the transferer. The fixing process is performed by the fixer. The other processes are performed by the other means.

The electrostatic latent image forming process is a process of forming an electrostatic latent image on an electrostatic latent image bearer.

The material, shape, structure, size, etc. of the electrostatic latent image bearer (a photoreceptor) are not particularly limited, and can be selected from known electrostatic latent image bearers. However, the electrostatic latent image bearer preferably has the shape of a drum, and the material is preferably an inorganic material such as amorphous silicon and serene, and an organic material such as polysilane and phthalopolymethine. Among these materials, the organic materials are preferably used in terms of high-quality images and long lives.

The electrostatic latent image is formed by uniformly charging the surface of the electrostatic latent image bearer and irradiating imagewise light onto the surface thereof with the electrostatic latent image former.

The electrostatic latent image former includes at least a charger uniformly charging the surface of the electrostatic latent image bearer and an irradiator irradiating imagewise light onto the surface thereof.

The surface of the electrostatic latent image bearer is charged with the charger upon application of voltage.

The charger is not particularly limited, and can be selected in accordance with the purpose, such as an electroconductive or semiconductive rollers, bushes, films, known contact chargers with a rubber blade, and non-contact chargers using a corona discharge such as corotron and scorotron. The charger for use in the present invention may have any shapes besides the roller, such as magnetic brushes and fur brushes, and is selectable according to a specification or a form of the electrophotographic image forming apparatus. The magnetic brush is formed of various ferrite particles such as Zn—Cu ferrite as a charging member, a non-magnetic electroconductive sleeve supporting the charging member and a magnet roll included by the non-magnetic electroconductive sleeve. The fur brush is a charger formed of a shaft subjected to an electroconductive treatment and a fur subjected to an electroconductive treatment with, e.g., carbon, copper sulfide, metals and metal oxides winding around or adhering to the shaft.

The charger is not limited to the contact chargers as mentioned above, but are preferably used because ozone generated therefrom can be reduced.

The surface of the electrostatic latent image bearer is irradiated with the imagewise light by the irradiator.

The irradiator is not particularly limited, and can be selected in accordance with the purpose, provided that the irradiator can irradiate the surface of the electrostatic latent image bearer with the imagewise light, such as reprographic optical irradiators, rod lens array irradiators, laser optical irradiators and a liquid crystal shutter optical irradiators.

In the present invention, a backside irradiation method irradiating the surface of the electrostatic latent image bearer through the backside thereof may be used.

The development process is a process of forming a visible image by developing the electrostatic latent image with the toner or developer of the present invention.

The image developer is not particularly limited, and can be selected from known image developers, provided that the image developer can develop with the toner or developer of the present invention. For example, an image developer containing the toner or developer of the present invention and being capable of feeding the toner or developer to the electrostatic latent image while contacting or not contacting thereto is preferably used.

The image developer may use a dry developing method or a wet developing method, and may develop a single color or multiple colors. For example, an image developer including a stirrer stirring the toner or developer to be charged and a rotatable magnet roller is preferably used.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visible image thereon.

The developer contained in the image developer including the toner of the present invention may be a one-component developer or a two-component developer, and either of which includes the toner of the present invention.

The transfer process is a process of transferring the visible image onto a recording medium, and it is preferable that the visible image is firstly transferred onto an intermediate transferer and secondly transferred onto a recording medium thereby. It is more preferable that two or more visible color images are firstly and sequentially transferred onto the intermediate transferer and the resultant complex full-color image is transferred onto the recording medium thereby.

The visible image is transferred by the transferer using a transfer charger charging the electrostatic latent image bearer (photoreceptor). The transferer preferably includes a first transferer transferring the two or more visible color images onto the intermediate transferer and a second transferer transferring the resultant complex full-color image onto the recording medium.

The intermediate transferer is not particularly limited, and can be selected from known transferers in accordance with the purpose, such as a transfer belt.

The intermediate transferer preferably has a static friction coefficient of from 0.1 to 0.6, and more preferably from 0.3 to 0.5. In addition, the intermediate transferer preferably has a volume resistance of from several to $10^3$ Ωcm. When the intermediate transferer has a volume resistance of from several to $10^3$ Ωcm, it is prevented that the intermediate transferer itself is charged and a charge is difficult to remain thereon to prevent an uneven second transfer. Further, a transfer bias can easily be applied thereto.

Materials therefor are not limited and any known materials can be used. Specific examples thereof include:

(1) a single layer belt formed of a material having high Young's modulus (tensile elasticity) such as PC (polycarbonate), PVDF (polyvinylidenefluoride), PAT (polyalkyleneterephthalate), a mixture of PC and PAT, a mixture of ETFE (ethylenetetrafluoroethylene copolymer) and PC, a mixture of ETFE and PAT, a mixture of PC and PAT and a thermosetting polyimide in which carbon black dispersed, which has a small transformed amount against a stress when an image is formed;

(2) a two or three layer belt including a surface layer or an intermediate layer based on the above-mentioned belt having high Young's modulus, which prevents hollow line images due to a hardness of the single layer belt; and (3) a belt formed of a rubber and an elastomer having comparatively a low Young's modulus, which has an advantage of scarcely producing hollow line images due to its softness, and being low-cost because of not needing a rib or a meandering inhibitor when the belt is wider than a driving roller and an extension roller such that an elasticity of an edge of the belt projecting therefrom prevents the meandering.

The intermediate transfer belt is conventionally formed of a fluorocarbon resin, a polycarbonate resin and a polyimide resin. However, an elastic belt which is wholly or partially an elastic member is used recently. Transferring a full-color image with a resin belt has the following problems.

A full-color image is typically formed of 4 colored toners. The full-color image includes 1 to 4 toner layers. The toner layer receives a pressure from a first transfer (transfer from a photoreceptor to an intermediate transfer belt) and a second transfer (from the intermediate transfer belt to a sheet), and agglutinability of the toner increases, resulting in production of hollow letter images and edgeless solid images. Since a resin belt has a high hardness and does not transform according to a toner layer, it tends to compress the toner layer, resulting in production of hollow letter images.

Recently, demands for forming an image on various sheets such as a Japanese paper and a sheet purposefully having a concavity and convexity are increasing. However, a paper having a poor smoothness tends to have an air gap with a toner when transferred thereon and hollow images tend to be produced thereon. When a transfer pressure of the second transfer is increased to increase an adhesion of the toner to the paper, agglutinability of the toner increases, resulting in production of hollow letter images.

The elastic belt transforms according to a toner layer and a sheet having a poor smoothness at a transfer point. Since the elastic belt transforms following to a local concavity and convexity, it adheres a toner to a paper well without giving an excessive transfer pressure to a toner layer, and therefore a transfer image having good uniformity can be formed even on a sheet having a poor smoothness without hollow letter images.

Specific examples of the resin for the elastic belt include polycarbonate; fluorocarbon resins such as ETFE and PVDF; styrene resins (polymers or copolymers including styrene or a styrene substituent) such as polystyrene, chloropolystyrene, poly-α-methylstyrene, a styrene-butadiene copolymer, a styrene-vinylchloride copolymer, a styrene-vinylacetate copolymer, a styrene-maleate copolymer, a styrene-esteracrylate copolymer (a styrene-methylacrylate copolymer, a styrene-ethylacrylate copolymer, a styrene-butylacrylate copolymer, a styrene-octylacrylate copolymer and a styrene-phenylacrylate copolymer), a styrene-estermethacrylate copolymer (a styrene-methylmethacrylate copolymer, a styrene-ethylmethacrylate copolymer and a styrene-phenylmethacrylate copolymer), a styrene-α-methylchloroacrylate copolymer and a styrene-acrylonitrile-esteracrylate copolymer; a methylmethacrylate resin; a butyl methacrylate resin; an ethyl acrylate resin; a butyl acrylate resin; a modified acrylic resin such as a silicone-modified acrylic resin, a vinylchloride resin-modified acrylic resin and an acrylic urethane resin; a vinylchloride resin; a styrene-vinylacetate copolymer; a vinylchloride-vinyl-acetate copolymer; a rosin-modified maleic acid resin; a phenol resin; an epoxy resin; a polyester resin; a polyester polyurethane resin; polyethylene; polypropylene; polybutadiene; polyvinylidenechloride; an ionomer resin; a polyurethane resin; a silicone resin; a ketone resin; an ethylene-ethylacrylate copolymer; a xylene resin; a polyvinylbutyral resin; a polyamide resin; a modified-polyphenyleneoxide resin, etc. These can be used alone or in combination. However, these are not limited thereto.

Specific examples of an elastic rubber and an elastomer include a butyl rubber, a fluorinated rubber, an acrylic rubber, EPDM, NBR, an acrylonitrile-butadiene-styrene natural rubber, an isoprene rubber, a styrene-butadiene rubber, a butadiene rubber, an ethylene-propylene rubber, an ethylene-propylene terpolymer, a chloroprene rubber, chlolosulfonated polyethylene, chlorinated polyethylene, a urethane rubber, syndiotactic 1,2-polybutadiene, an epichlorohydrin rubber, a silicone rubber, a fluorine rubber, a polysulfide rubber, a polynorbornene rubber, a hydrogenated nitrile rubber; and a thermoplastic elastomer such as a polystyrene elastomer, a polyolefin elastomer, a polyvinylchloride elastomer, a polyurethane elastomer, a polyamide elastomer, a polyurea elastomer, a polyester elastomer and a fluorocarbon resin elastomer; etc. These can be used alone or in combination. However, these are not limited thereto.

Specific examples of a conductant controlling a resistivity include a metallic powder such as carbon black, graphite, aluminium and nickel; and an electroconductive metal oxide such as a tin oxide, a titanium oxide, a antimony oxide, an indium oxide, kalium titanate, an antimony oxide-tin oxide complex oxide and an indium oxide-tin oxide complex oxide. The electroconductive metal oxide may be coated with an insulative particulate material such as barium sulfate, magnesium silicate and calcium carbonate. These are not limited thereto.

A surface layer material of the elastic material does not contaminate photoreceptor and decrease surface friction of a transfer belt to increase cleanability and second transferability of a toner. For example, one, or two or more of a polyurethane resin, a polyester resin and an epoxy resin can reduce a surface energy and increase a lubricity. A powder or a particulate material of one, or two or more of a fluorocarbon resin, a fluorine compound, fluorocarbon, a titanium dioxide, silicon carbide can be also used. A material having a surface layer including many fluorine atoms when heated, and having a small surface energy such as a fluorinated rubber can also be used.

The belt can be prepared by the following methods, but the methods are not limited thereto and the belt is typically prepared by combinations of plural methods.

(1) A centrifugal forming method of feeding materials into a rotating cylindrical mold.

(2) A spray coating method of spraying a liquid coating to form a film.

(3) A dipping method of dipping a cylindrical mold in a material solution.

(4) A casting method of casting materials into an inner mold and an outer mold.

(5) A method of winding a compound around a cylindrical mold to perform a vulcanizing grind.

As a method of preventing an elongation of the elastic belt, a method of forming a rubber layer on a resin layer having a hard center with less elongation and a method of including an elongation inhibitor in a layer having a hard center are used.

Specific examples of the elongation inhibitor include, but are not limited to, a natural fiber such as cotton and silk; a synthetic fiber such as a polyester fiber, a nylon fiber, an acrylic fiber, a polyolefin fiber, a polyvinylalcohol fiber, a polyvinylchloride fiber, a polyvinylidenechloride fiber, a polyurethane fiber, a polyacetal fiber, a polyfluoroethylene fiber and a phenol fiber; an inorganic fiber such as a carbon fiber, a glass fiber and a boron fiber; and a metallic fiber such as an iron fiber and a copper fiber. These can be used alone or in combination in form of a fabric or a filament.

Any twisting methods such as twisted one or plural filaments, a piece twist yarn, a ply yarn and two play yarn can be used. The filament can be subject to an electroconductive treatment.

Any fabrics such as a knitted fabric and a mixed weave fabric can be used, and can be subject to an electroconductive treatment.

Specific examples of a method of preparing a layer having a hard center include a method of covering a cylindrically-woven fabric over a metallic mold and forming a coated layer thereon; a dipping a cylindrically-woven fabric in a liquid rubber and forming a coated layer on one side or both sides thereof; and a method of spirally winding a thread around a metallic mold and forming a coated layer thereon.

When the elastic layer is too thick, expansion and contraction of the surface becomes large and tends to have a crack, although depending on a hardness thereof. When the expansion and contraction of the surface becomes large, the resultant image largely expands and contracts. Therefore, it is not preferable that the elastic layer is too thick, but it preferably has a thickness not less than 1 mm.

Each of the first and second transferees is preferably at least a transferer chargeable to separate the visible image from the electrostatic latent image bearer (photoreceptor) toward the recoding medium. The transferer may be one, or two or more.

The transferer includes a corona transferer using a corona discharge, a transfer belt, a transfer roller, a pressure transfer roller, an adhesive roller, etc.

The recording medium is not particularly limited, and can be selected from known recording media, e.g., typically a plain paper and even a PET film for OHP.

The visible image transferred onto the recording medium is fixed thereon by a fixer. Each color toner image or the resultant complex full-color image may be fixed thereon.

The fixer is not particularly limited, can be selected in accordance with the purpose, and known heating and pressurizing means are preferably used. The heating and pressurizing means include a combination of a heating roller and a pressure roller, and a combination of a heating roller, a pressure roller and an endless belt, etc.

The heating temperature is preferably from 80 to 200° C.

In the present invention, a known optical fixer may be used with or instead of the fixer in accordance with the purpose.

The electrostatic latent image bearer is discharged by the discharger upon application of discharge bias.

The discharger is not particularly limited, and can be selected from known dischargers, provide that the discharger can apply the discharge bias to the electrostatic latent image bearer, such as a discharge lamp.

The toner remaining on the electrostatic latent image bearer is preferably removed by the cleaner.

The cleaner is not particularly limited, and can be selected from known cleaners, provide that the cleaner can remove the toner remaining thereon, such as a magnetic brush cleaner, an electrostatic brush cleaner, a magnetic roller cleaner, a blade cleaner, a brush cleaner and a web cleaner.

The toner removed by the cleaner is recycled into the image developer with a recycler.

The recycler is not particularly limited, and known transporters can be used.

The controller is not particularly limited, and can be selected in accordance with the purpose, provided the controller can control the above-mentioned means, such as a sequencer and a computer.

Figure 2:
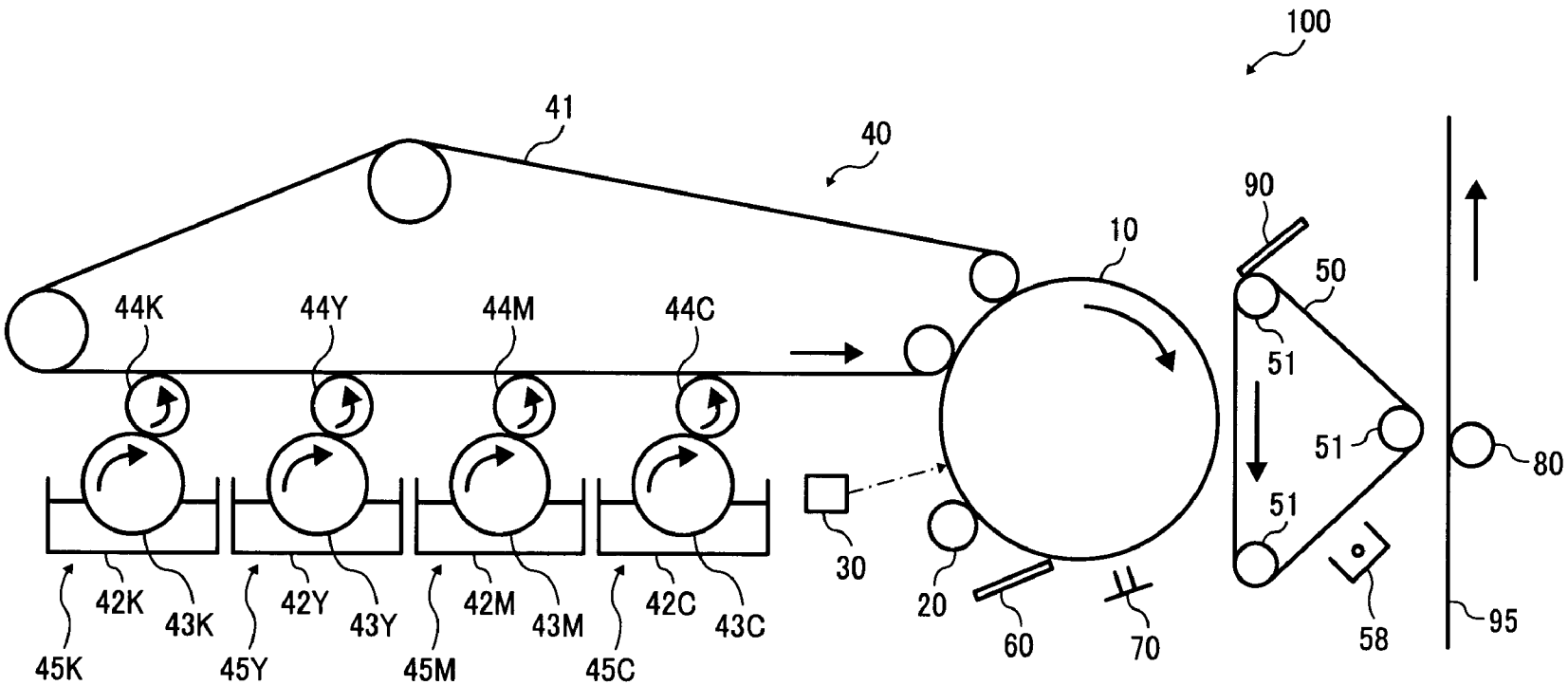
FIG. 2 is a schematic view illustrating an embodiment of the image forming apparatus of the present invention.

FIG. 2 is a schematic view illustrating an embodiment of the image forming apparatus of the present invention. An image forming apparatus 100 therein includes a photoreceptor drum 10 (hereinafter referred to as a photoreceptor 10) as an electrostatic latent image bearer, a charging roller as a charger 20, an irradiator 30, an image developer 40, an intermediate transferer 50, a cleaner 60 having a cleaning blade and a discharge lamp 70 as a discharger.

The intermediate transferer 50 is an endless belt suspended and extended by here rollers 51, and is transportable in the direction indicated by an arrow. The three rollers 51 partly work as a transfer bias roller capable of applying a predetermined first transfer bias to the intermediate transferer 50. A cleaner 90 having a cleaning blade is located close thereto and a transfer roller 80 capable of applying a transfer bias to a transfer paper 95 as a final transfer material to transfer (second transfer) the toner image thereon is located at the other side of the transfer paper 9. Around the intermediate transferer 50, a corona charger 58 charging the toner image thereon is located between a contact point of the photoreceptor 10 and the intermediate transferer 50 and a contact point of the intermediate transferer 50 and a transfer paper 95 in the rotating direction of the intermediate transferer 50.

The image developer 40 includes a developing belt 41 as a developer bearer, a black developing unit 45K, a yellow developing unit 45Y, a magenta developing unit 45M and a cyan developing unit 45C around the developing belt 41. The black developing unit 45K includes a developer container 42K, a developer feed roller 43K and a developing roller 44K; the yellow developing unit 45Y includes a developer container 42Y, a developer feed roller 43Y and a developing roller 44Y; the magenta developing unit 45M includes a developer container 42M, a developer feed roller 43M and a developing roller 44M; and the cyan developing unit 45C includes a developer container 42C, a developer feed roller 43C and a developing roller 44C. The developing belt 41 is an endless belt rotatably suspended and extended by plural rollers, and partly contacts the photoreceptor 10.

The charging roller 20 uniformly charges the photoreceptor 10. The irradiator 30 irradiates imagewise light to the photoreceptor 10 to form an electrostatic latent image thereon. The electrostatic latent image formed thereon is developed with a toner fed from the image developer 40 to form a visible image (toner image) thereon. The visible image (toner image) is transferred (first transfer) onto the intermediate transferer 50 with a voltage applied from the roller 51, and is further transferred (second transfer) onto a transfer paper 95. The toner remaining on the photoreceptor 10 is removed by a cleaner 60, and the photoreceptor 10 is discharged by the discharge lamp 70.

Figure 3:
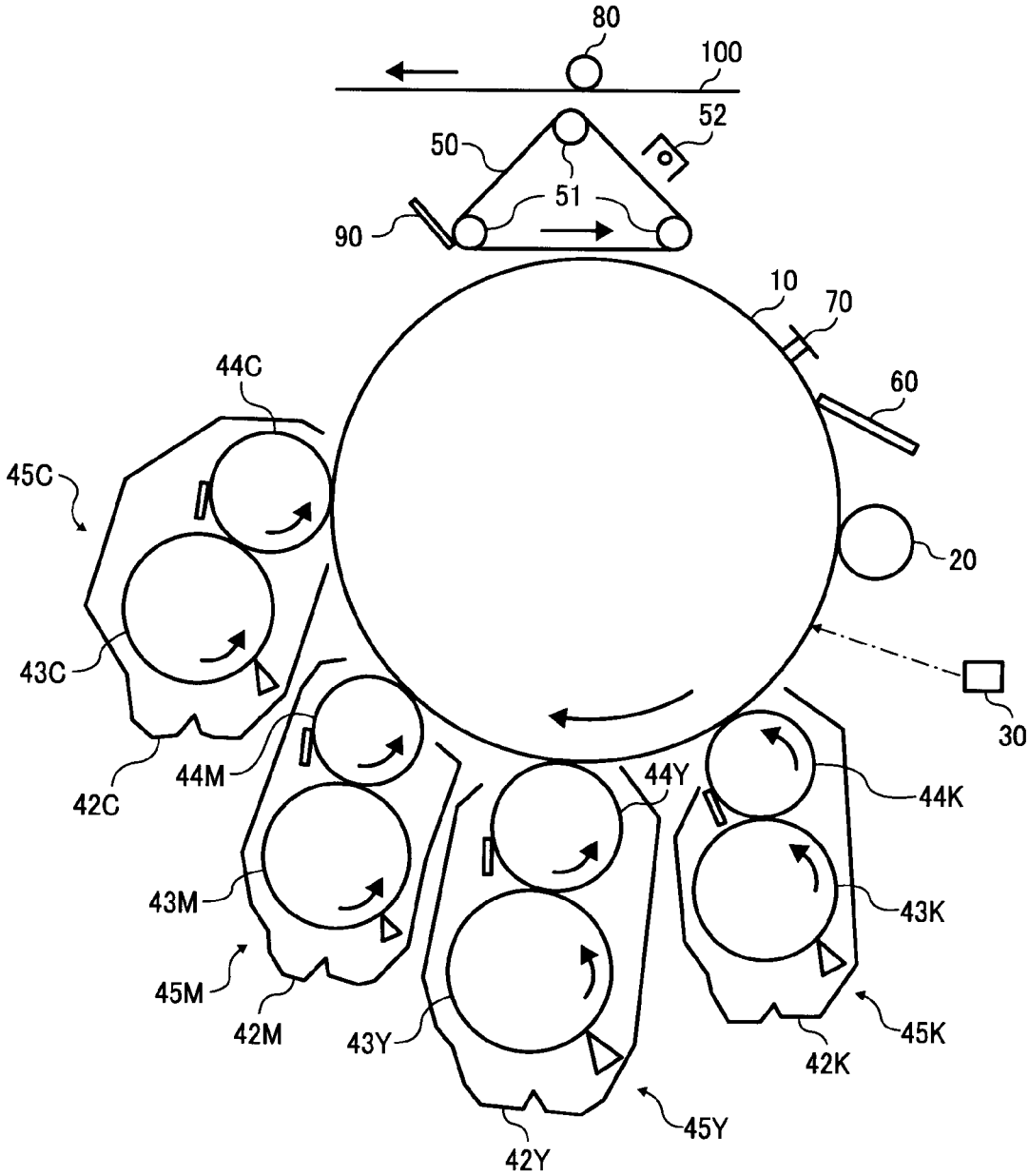
FIG. 3 is a schematic view illustrating another embodiment of the image forming apparatus of the present invention.

FIG. 3 is a schematic view illustrating another embodiment of the image forming apparatus of the present invention. An image forming apparatus 100 therein has the same constitutions as that of FIG. 2 except that the developing belt 41 is not located and the black developing unit 45K, yellow developing unit 45Y, magenta developing unit 45M and cyan developing unit 45C are located around the photoreceptor 10, facing thereto. The same elements therein have the same numbers as those in FIG. 2.

Figure 4:
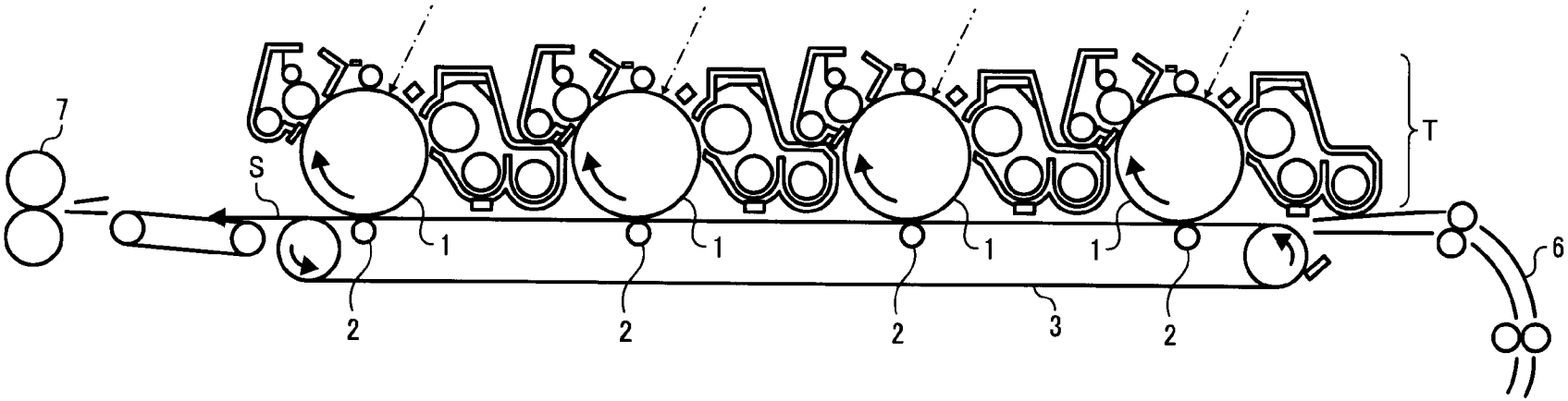
FIG. 4 is a schematic view illustrating a further embodiment of the image forming apparatus of the present invention, using a direct transfer method.
Figure 5:
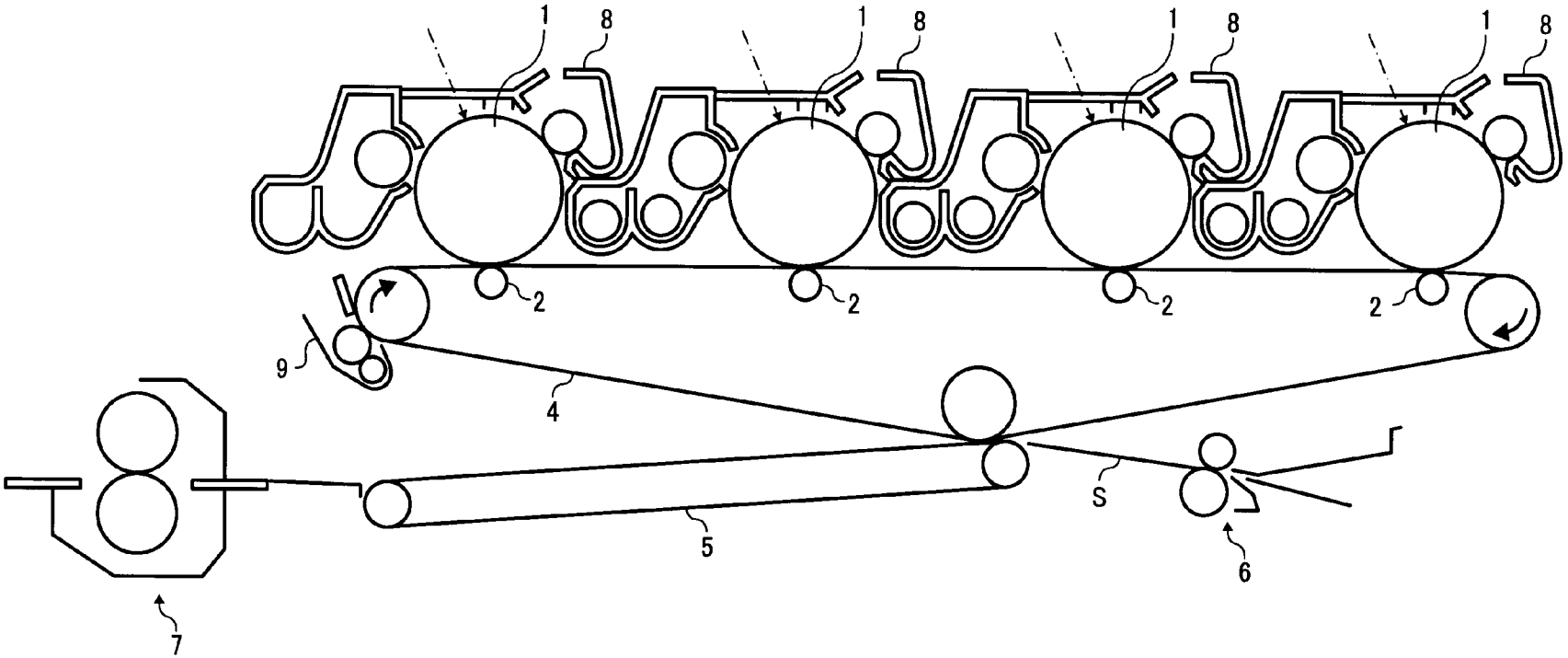
FIG. 5 is a schematic view illustrating another embodiment of the image forming apparatus of the present invention, using an indirect transfer method.

FIG. 4 is a schematic view illustrating an embodiment of a tandem image forming apparatus of the present invention. The tandem-type electrophotographic image forming apparatus includes an apparatus using a direct transfer method of sequentially transferring an image on each photoreceptor 1 with a transferer 2 onto a sheet s fed by a sheet feeding belt 3 as shown in FIG. 4, and an apparatus using an indirect transfer method of sequentially transferring an image on each photoreceptor 1 with a first transferer 2 onto an intermediate transferer 4 and transferring the image thereon onto a sheet with a second transferer 5 as shown in FIG. 5. The second transferer 5 has the shape of a belt, and may have the shape of a roller.

The direct transfer method has a disadvantage of being large toward a sheet feeding direction because a paper feeder 6 is located in an upstream of a tandem-type image forming apparatus T having photoreceptors 1 in line, and a fixer 7 in a downstream thereof. To the contrary, the indirect method can be downsized because of being able to freely locate the second transferer, and can locate a paper feeder 6 and a fixer 7 together with a tandem-type image forming apparatus T.

To avoid being large toward a sheet feeding direction, the former method locates the fixer 7 close to the tandem-type image forming apparatus T. Therefore, the sheet s cannot flexibly enter the fixer 7, and an impact thereof to the fixer 7 when entering the fixer 7 and a difference of feeding speed of the sheet s between when passing through the fixer 7 and when fed by a feeding belt tend to affect an image formation in the upstream. To the contrary, the latter method can flexibly locate the fixer 7, and therefore the fixer 7 scarcely affects the image formation.

Therefore, recently, the tandem-type electrophotographic image forming apparatus using an indirect transfer method is widely used.

FIG. 5 is a schematic view illustrating another embodiment of the image forming apparatus of the present invention, using an indirect transfer method. In this type of full-color electrophotographic image forming apparatus, as shown in FIG. 5, a photoreceptor cleaner 8 removes a residual toner on a photoreceptor 1 to clean the surface thereof after a first transfer and ready for another image formation. In addition, an intermediate transferer cleaner 9 removes a residual toner on an intermediate transferer 4 to clean the surface thereof after second transfer and ready for another image formation.

Figure 6:
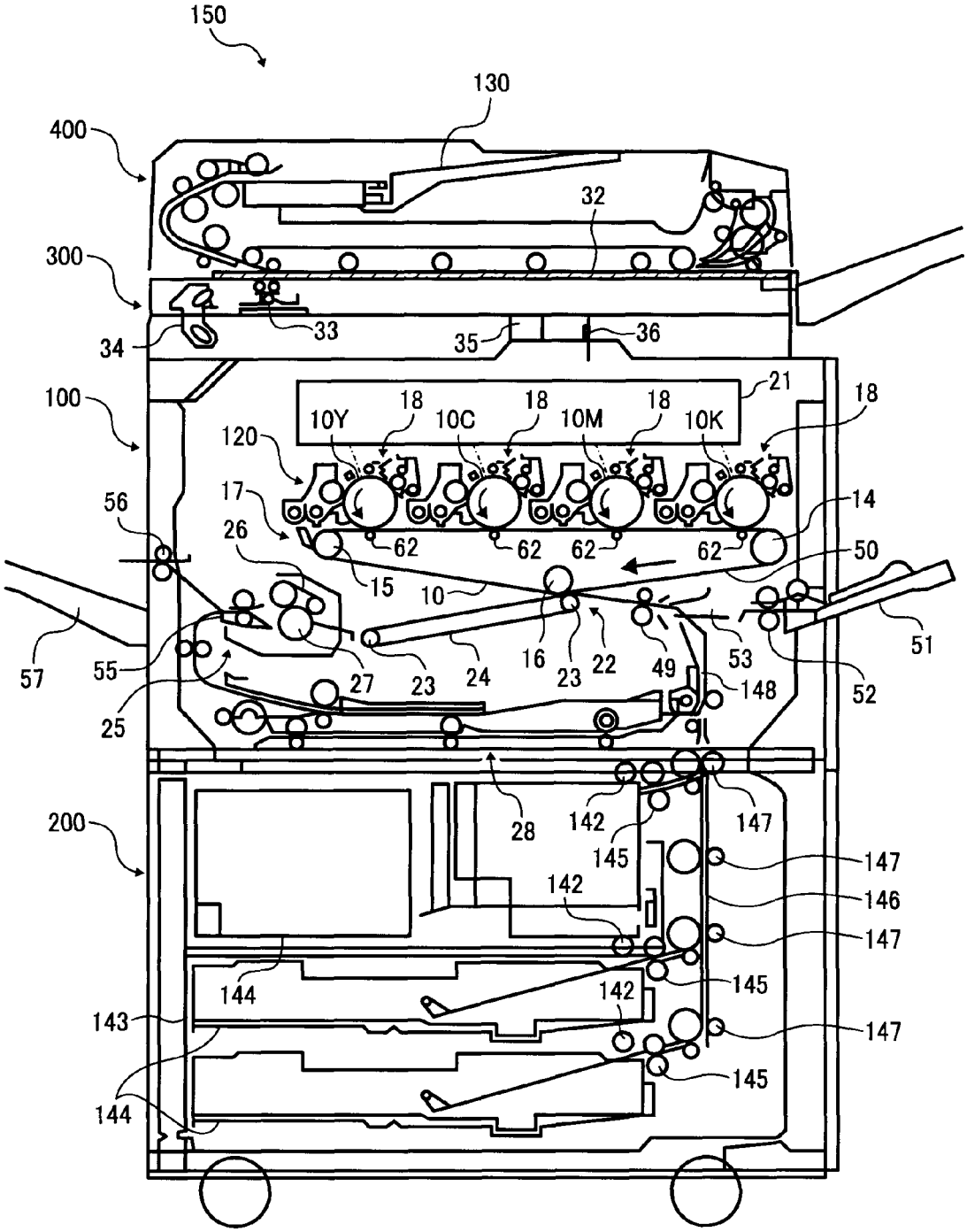
FIG. 6 is a schematic view illustrating an embodiment of the tandem image forming apparatus of the present invention.

FIG. 6 is a schematic view illustrating a tandem full-color image forming apparatus of the present invention. The tandem image forming apparatus 100 includes a duplicator 150, a paper feeding table 200, a scanner 300 and an automatic document feeder (ADF) 400.

The duplicator 150 includes an intermediate transferer 50 having the shape of an endless belt. The intermediate transferer 50 is suspended by three suspension rollers 14, 15 and 16 and rotatable in a clockwise direction. On the left of the suspension roller 15, an intermediate transferer cleaner 17 is located to remove a residual toner on an intermediate transferer 50 after an image is transferred. Above the intermediate transferer 50, four image forming units 18 for yellow, cyan, magenta and black colors are located in line from left to right along a transport direction of the intermediate transferer 50 to form a tandem image forming developer 120. Above the tandem color image developer 120, an irradiator 21 is located. On the opposite side of the tandem color image developer 120 across the intermediate transferer 50, a second transferer 22 is located. The second transferer 22 includes a an endless second transfer belt 24 and two rollers 23 suspending the endless second transfer belt 24, and is pressed against the suspension roller 16 across the intermediate transferer 50 and transfers an image thereon onto a sheet. Beside the second transferer 22, a fixer 25 fixing a transferred image on the sheet is located.

Below the second transferer 22 and the fixer 25, a sheet reverser 28 reversing the sheet to form an image on both sides thereof is located in the tandem color image forming apparatus 100.

Next, full-color image formation using a tandem image developer 120 will be explained. An original is set on a table 130 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the color original (color image) as image information of black, yellow, magenta and cyan.

Figure 7:
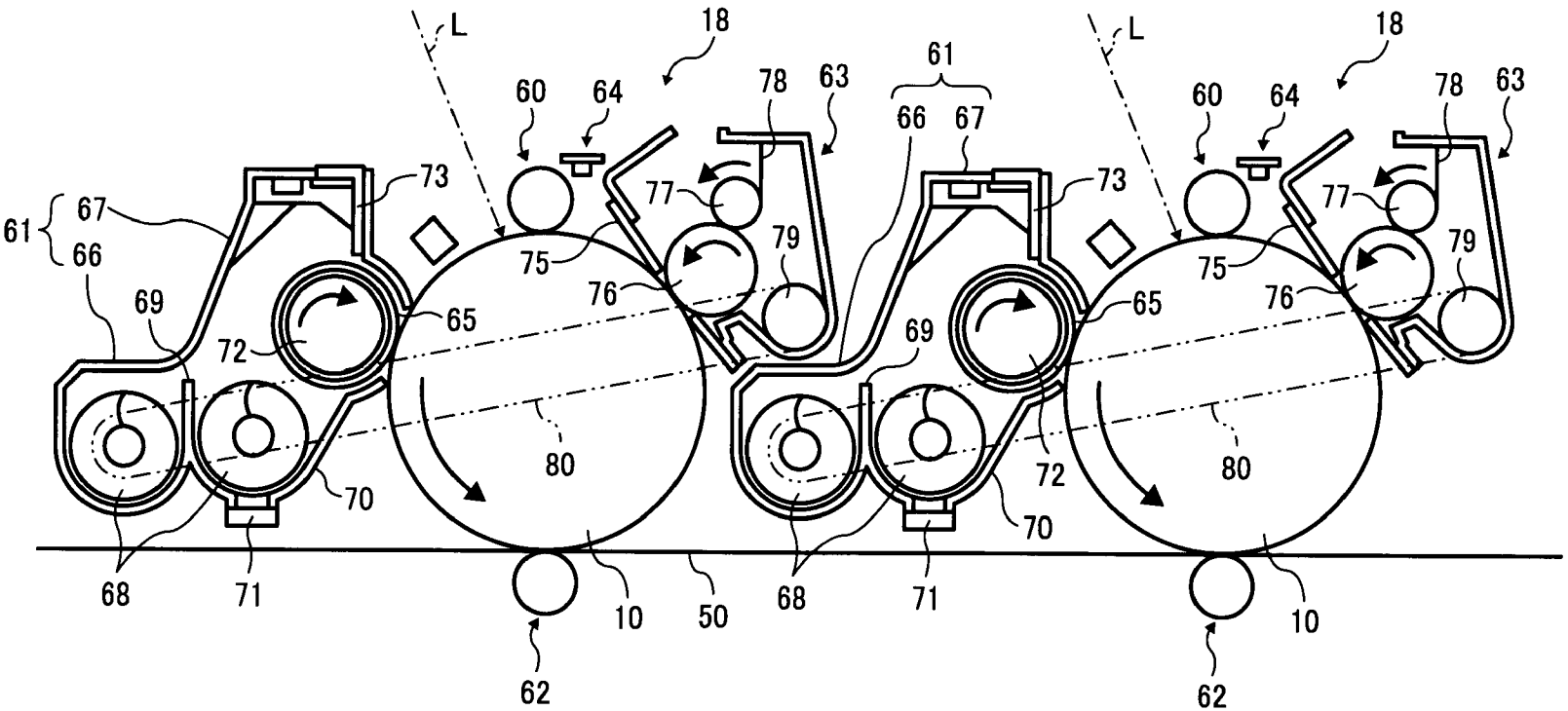
FIG. 7 is a schematic view illustrating a further embodiment of the image forming apparatus of the present invention.

The black, yellow, magenta and cyan image information are transmitted to each image forming units 18, i.e., a black image forming unit, a yellow image forming unit, a magenta image forming unit and a cyan image forming unit in the tandem image developer 120 respectively, and the respective image forming units form a black toner image, a yellow toner image, a magenta toner image and a cyan toner image. Namely, each of the image forming units 18 in the tandem image developer 120 includes, as shown in FIG. 7, a photoreceptor 10, i.e., a photoreceptor for black 10K, a photoreceptor for yellow 10Y, a photoreceptor for magenta 10M and a photoreceptor for cyan 10C; a charger 60 uniformly charging the photoreceptor; an irradiator irradiating the photoreceptor with imagewise light (L in FIG. 7) based on each color image information to form an electrostatic latent image thereon; an image developer 61 developing the electrostatic latent image with each color toner, i.e., a black toner, a yellow toner, a magenta toner and a cyan toner to form a toner image thereon; a transfer charger 62 transferring the toner image onto an intermediate transferer 50; a photoreceptor cleaner 63; and a discharger 64. When a start switch (not shown) is put on, a drive motor (not shown) rotates one of the suspension rollers 14, 15 and 16 such that the other two rollers are driven to rotate, to rotate the intermediate transferer 50. At the same time, each of the image forming units 18 rotates a photoreceptor 10 and forms a single-colored image, i.e., a black image (K), a yellow image (Y), a magenta image (M) and cyan image (C) on each photoreceptor 10K, 10Y, 10M and 10C. The single-colored images are sequentially transferred (first transfer) onto the intermediate transferer 50 to form a full-color image thereon.

On the other hand, when start switch (not shown) is put on, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a resist roller 49. Alternatively, a paper feeding roller 150 is rotated to take a sheet out of a manual feeding tray 51, and a separation roller 52 separates sheets one by one and feed the sheet into a paper feeding route 53 to be stopped against the resist roller 49. The resist roller 49 is typically earthed, and may be biased to remove a paper dust from the sheet.

Then, in timing with a synthesized full-color image on the intermediate transferer 50, the resist roller 49 is rotated to feed the sheet between the intermediate transferer 50 and the second transferer 22, and the second transferer transfers (second transfer) the full-color image onto the sheet. The intermediate transferer 50 after transferring an image is cleaned by the intermediate transferer cleaner 17 to remove a residual toner thereon after the image is transferred.

The sheet the full-color image is transferred on is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

The image forming apparatus and process cartridge of the present invention, each of which uses a toner having high cleanability and transferability and stably producing high-quality images having good microscopic dot reproducibility even at a high temperature and/or a high humidity, efficiently produce high-quality images.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES 229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs, 44 parts of trimellitic acid anhydride were added thereto and the mixture was reacted for 2 hrs at a normal pressure and 180° C. to prepare an unmodified polyester resin.

The unmodified polyester resin had a number-average molecular weight of 2,500, a weight-average molecular weight of 6,700, a Tg of 43° C. and an acid value of 25 mg KOH/g.

1,200 parts of water, 540 parts of carbon black Printex 35 from Degussa A.G. having a DBP oil absorption of 42 ml/100 mg and a pH of 9.5, 1,200 parts of the unmodified polyester resin were mixed by a Henschel mixer from Mitsui Mining Co., Ltd. After the mixture was kneaded by a two-roll mill having a surface temperature of 110° C. for 1 hr, the mixture was extended by applying pressure, cooled and pulverized by a pulverizer from Hosokawa Micron Limited to prepare a masterbatch.

378 parts of the unmodified polyester resin, 110 parts of carnauba wax, 22 parts of a metal complex of salicylic acid E-84 from Orient Chemical Industries Co., Ltd. and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the master batch 1 and 500 parts of ethyl acetate were added to the mixture and mixed for 1 hr to prepare a material solution.

1,324 parts of the material solution were transferred into another vessel, and the carbon black and wax therein were dispersed by a beads mill (Ultra Visco Mill from IMECS CO., LTD.) for 3 passes at a liquid feeding speed of 1 kg/hr and a peripheral disc speed of 6 m/sec using zirconia beads having diameter of 0.5 mm for 80% by volume to prepare a wax dispersion.

Next, 1,324 parts of an ethyl acetate solution of the unmodified polyester resin having a concentration of 65% were added to the wax dispersion. 3 parts of layered inorganic mineral montmorillonite, at least a part of which is modified with a quaternary ammonium salt having a benzyl group, Clayton APA from Southern Clay Products, Inc. were added to 200 parts of the wax dispersion subjected to one pass using the Ultra Visco Mill under the same conditions to prepare a mixture. The mixture was stirred for 30 min with T. K. Homodisper from Tokushu Kika Kogyo Co., Ltd. to prepare a toner constituents dispersion.

The viscosity of the toner constituents dispersion was measured as follows.

After shearing strength was applied thereto with a parallel plate type rheometer AR2000 equipped with a parallel plat having a diameter of 20 mm from TA Instruments, Japan, at a gap of 30 μm, a shearing speed of 30,000 $sec^{-1}$, 25° C. for 30 sec, the viscosity (A) thereof when the shearing speed was changed from 0 $sec^{-1}$ to 70 $sec^{-1}$ for 20 sec was measured. In addition, the viscosity (B) thereof when a shearing strength was applied thereto with a parallel plate type rheometer AR2000 at a shearing speed of 30,000 $sec^{-1}$, 25° C. for 30 sec was measured.

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 7 hrs at a normal pressure and 230° C. Further, after the mixture was depressurized by 10 to 15 mm Hg and reacted for 5 hrs to prepare an intermediate polyester resin.

The intermediate polyester resin had a number-average molecular weight of 2,100, a weight-average molecular weight of 9,500, a Tg of 55° C. and an acid value of 0.5 mg KOH/g and a hydroxyl value of 51 mg KOH/g.

Next, 410 parts of the intermediate polyester resin, 89 parts of isophoronediisocyanate and 500 parts of ethyl acetate were reacted in a reactor vessel including a cooling pipe, a stirrer and a nitrogen inlet pipe for 5 hrs at 100° C. to prepare a prepolymer. The prepolymer included a free isocyanate in an amount of 1.53% by weight.

170 parts of isophoronediamine and 75 parts of methyl ethyl ketone were reacted at 50° C. for 5 hrs in a reaction vessel including a stirrer and a thermometer to prepare a ketimine compound. The ketimine compound had an amine value of 418 mg KOH/g.

749 parts of the toner constituents dispersion, 115 parts of the prepolymer and 2.9 parts of the ketimine compound were mixed in a vessel by a TK-type homomixer from Tokushu Kika Kogyo Co., Ltd. at 5,000 rpm for 1 min to prepare an oil phase mixed liquid.

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare a particulate resin dispersion.

In the present invention, the toner dispersion diameter and the dispersion diameter distribution were measured with MICROTRAC UPS-150 from NIKKISO CO., LTD., and analyzed with a analysis software MICROTRAC particle size analyzer Ver. 10.1.2-016EE from NIKKISO CO., LTD. Specifically, the toner constituents dispersion was placed in a glass sample bottle having a capacity of 30 ml and the solvent used for preparing the toner constituents dispersion was added thereto to prepare a dispersion including the toner constituents in an amount of 10% by weight. The dispersion was dispersed for 2 min by an ultrasonic disperser W-113MK-II from HONDA ELECTRONICS CO., LTD.

After the background was measured with the solvent used for preparing the toner constituents dispersion, the dispersion was subjected to instillation and the dispersion particle diameter was measured such that a sample loading value of the UPS-150 was from 1 to 10. This is essential in terms of measurement reproducibility of the dispersion particle diameter. The dropping amount of the dispersion needs controlling to obtain the sample loading value.

The measurement and analysis conditions are as follows.

Distribution display: volume
Particle diameter classification selection: standard
The number of channels: 44
Measurement time: 60 sec
The number of measurement: once
Particle permeability: permeable
Particle flexibility: 1.5
Particle form: nonspheric
Density: 1 g/cm$^3$ A value of the solvent used for preparing the toner constituents dispersion, which is described in "Guideline on Input Conditions in Measurement" published by NIKKISO CO., LTD. was used as a value of the solvent flexibility.

990 parts of water, 83 parts of the [particulate dispersion liquid 1], 37 parts of an aqueous solution of sodium dodecyldiphenyletherdisulfonate having a concentration of 48.5% (ELEMINOL MON-7 from Sanyo Chemical Industries, Ltd.), 135 parts of an aqueous solution having a concentration of 1% by weight of a polymer dispersant carboxymethylcellulose sodium Selogen BS-H-3 from DAI-ICHI KOGYO SEIYAKU CO., LTD. and 90 parts of ethyl acetate were mixed and stirred to prepare an aqueous medium.

867 parts of the oil phase mixed liquid was added to 1,200 parts of the aqueous medium and mixed therewith by a TK-type homomixer at 13,000 rpm for 20 min to prepare an emulsion slurry.

The emulsion slurry was placed in a vessel including a stirrer and a thermometer. After a solvent was removed from the emulsion slurry at 30° C. for 8 hrs, it was aged at 45° C. for 4 hrs to prepare a dispersion slurry.

The Dv and Dn were measured by Multisizer III from Beckman Coulter, Inc. using an aperture of 100 μm. An analysis software Beckman Multisizer 3 Version 3.51 was used. Specifically, 0.5 g of the toner and 0.5 ml of a surfactant (alkylbenzenesulfonate Neogen SC-A from Dai-ichi Kogyo Seiyaku Co., Ltd.) having a concentration of 10% by weight were mixed with a micro spatel in a glass beaker having a capacity of 100 ml, and 80 ml of ion-exchange water was added to the mixture. The mixture was dispersed by an ultrasonic disperser W-113MK-II from HONDA ELECTRONICS CO., LTD. for 10 min. The dispersion was measure by Multisizer III using ISOTON III as a measurement solution from Beckman Coulter, Inc. The dispersion was dropped such that Multisizer III displays a concentration of 8±2%, which is essential in terms of measurement reproducibility of the particle diameter. The particle diameter has no accidental error in the range of the concentration.

After the dispersion slurry was filtered under reduced pressure, 100 parts of ion-exchange water were added to the resultant filtered cake and mixed by the TK-type homomixer at 12,000 rpm for 10 min, and the mixture was filtered.

A hydrochloric acid having a concentration of 10% by weight was added to the filtered cake to have a pH of 2.8 and mixed by the TK-type homomixer at 12,000 rpm for 10 min, and the mixture was filtered.

Further, 300 parts of ion-exchange water were added to the filtered cake and mixed by the TK-type homomixer at 12,000 rpm for 10 min, and the mixture was filtered twice to prepare a final filtered cake.

The final filtered cake was dried by an air drier at 45° C. for 48 hrs and sieved by a mesh having an opening of 75 μm to prepare parent toner particles. The average circularity of the parent toner particles was 0.955 and Dv/Dn was 1.15.

The following external additives were used in Examples and Comparative Examples:

(A) surface-treated hydrophobic silica with hexamethyldisilazane, having an average primary particle diameter of 12 nm and a hydrophobicity of 65%;

(B) surface-treated hydrophobic silica with dimethyldichlorosilane, having an average primary particle diameter of 7 nm and a hydrophobicity of 55%;

(C) surface-treated hydrophobic titanium oxide with isobutyltrimethoxysilane, having an average primary particle diameter of 16 nm and a hydrophobicity of 70%;

(D) surface-treated hydrophobic titanium oxide with isobutyltrimethoxysilane, having an average primary particle diameter of 35 nm and a hydrophobicity of 70%;

(E) surface-treated hydrophobic silica with hexamethyldisilazane, having an average primary particle diameter of 70 nm, a hydrophobicity of 65% and a weight reduction rate of 0.8%, and including particles having a diameter not less than 200 nm in an amount of 8% by number;

(F) surface-treated hydrophobic silica with hexamethyldisilazane, having an average primary particle diameter of 120 nm, a hydrophobicity of 65% and a weight reduction rate of 6%, and including particles having a diameter not less than 200 nm in an amount of 13% by number;

(G) surface-treated hydrophobic silica with hexamethyldisilazane, having an average primary particle diameter of 130 nm, a hydrophobicity of 65% and a weight reduction rate of 0.5%, and including particles having a diameter not less than 200 nm in an amount of 18% by number;

(H) surface-treated hydrophobic silica with hexamethyldisilazane, having an average primary particle diameter of 140 nm, a hydrophobicity of 65% and a weigh t reduction rate of 0.7%, and including particles having a diameter not less than 200 nm in an amount of 22% by number;

(I) surface-treated hydrophobic silica with hexamethyldisilazane, having an average primary particle diameter of 180 nm, a hydrophobicity of 65% and a weigh t reduction rate of 7%, and including particles having a diameter not less than 200 nm in an amount of 41% by number;

Example 1

0.6 parts of the external additive (A) and 0.7 parts of the external additive (C) were mixed with 100 parts of the parent toner particles by a Henschel Mixer Mitsui Mining Co., Ltd. at a peripheral speed of 33 m/s for 3 min, and 0.5 parts of the external additive (G) was further mixed therewith at a peripheral speed of 33 m/s for 3 min to prepare a powder. The powder was passed through a mesh having an opening of 38 μm to remove coarse particles. Thus, a toner A onto which hydrophobic fine powders were externally added was prepared.

Example 2

0.6 parts of the external additive (A) and 0.7 parts of the external additive (D) were mixed with 100 parts of the parent toner particles by a Henschel Mixer Mitsui Mining Co., Ltd. at a peripheral speed of 33 m/s for 3 min, and 1.2 parts of the external additive (H) was further mixed therewith at a peripheral speed of 33 m/s for 3 min to prepare a powder. The powder was passed through a mesh having an opening of 38 μm to remove coarse particles. Thus, a toner B onto which hydrophobic fine powders were externally added was prepared.

Example 3

0.6 parts of the external additive (A) and 0.7 parts of the external additive (C) were mixed with 100 parts of the parent toner particles by a Henschel Mixer Mitsui Mining Co., Ltd. at a peripheral speed of 33 m/s for 3 min, and 1.2 parts of the external additive (G) was further mixed therewith at a peripheral speed of 33 m/s for 3 min to prepare a powder. The powder was passed through a mesh having an opening of 38 μm to remove coarse particles. Thus, a toner C onto which hydrophobic fine powders were externally added was prepared.

Example 4

0.7 parts of the external additive (A) and 0.5 parts of the external additive (C) were mixed with 100 parts of the parent toner particles by a Henschel Mixer Mitsui Mining Co., Ltd. at a peripheral speed of 33 m/s for 3 min, and 1.5 parts of the external additive (G) was further mixed therewith at a peripheral speed of 33 m/s for 3 min to prepare a powder. The powder was passed through a mesh having an opening of 38 μm to remove coarse particles. Thus, a toner D onto which hydrophobic fine powders were externally added was prepared.

Example 5

0.8 parts of the external additive (A) and 0.7 parts of the external additive (C) were mixed with 100 parts of the parent toner particles by a Henschel Mixer Mitsui Mining Co., Ltd. at a peripheral speed of 33 m/s for 3 min, and 1.5 parts of the external additive (H) was further mixed therewith at a peripheral speed of 33 m/s for 3 min to prepare a powder. The powder was passed through a mesh having an opening of 38 μm to remove coarse particles. Thus, a toner E onto which hydrophobic fine powders were externally added was prepared.

Comparative Example 1

0.6 parts of the external additive (A) and 0.7 parts of the external additive (C) were mixed with 100 parts of the parent toner particles by a Henschel Mixer Mitsui Mining Co., Ltd. at a peripheral speed of 33 m/s for 3 min, and 1.2 parts of the external additive (F) was further mixed therewith at a peripheral speed of 33 m/s for 3 min to prepare a powder. The powder was passed through a mesh having an opening of 38 μm to remove coarse particles. Thus, a toner F onto which hydrophobic fine powders were externally added was prepared.

Comparative Example 2

0.6 parts of the external additive (A) and 0.7 parts of the external additive (C) were mixed with 100 parts of the parent toner particles by a Henschel Mixer Mitsui Mining Co., Ltd. at a peripheral speed of 33 m/s for 3 min, and 1.2 parts of the external additive (E) was further mixed therewith at a peripheral speed of 33 m/s for 3 min to prepare a powder. The powder was passed through a mesh having an opening of 38 μm to remove coarse particles. Thus, a toner G onto which hydrophobic fine powders were externally added was prepared.

Comparative Example 3

0.6 parts of the external additive (A) and 0.7 parts of the external additive (C) were mixed with 100 parts of the parent toner particles by a Henschel Mixer Mitsui Mining Co., Ltd. at a peripheral speed of 33 m/s for 3 min, and 1.2 parts of the external additive (I) was further mixed therewith at a peripheral speed of 33 m/s for 3 min to prepare a powder. The powder was passed through a mesh having an opening of 38 μm to remove coarse particles. Thus, a toner H onto which hydrophobic fine powders were externally added was prepared.

Comparative Example 4

0.6 parts of the external additive (A) were mixed with 100 parts of the parent toner particles by a Henschel Mixer Mitsui Mining Co., Ltd. at a peripheral speed of 33 m/s for 3 min, and 1.2 parts of the external additive (G) was further mixed therewith at a peripheral speed of 33 m/s for 3 min to prepare a powder. The powder was passed through a mesh having an opening of 38 μm to remove coarse particles. Thus, a toner I onto which hydrophobic fine powders were externally added was prepared.

Comparative Example 5

0.6 parts of the external additive (A) and 0.7 parts of the external additive (C) were mixed with 100 parts of the parent toner particles by a Henschel Mixer Mitsui Mining Co., Ltd. at a peripheral speed of 33 m/s for 3 min to prepare a powder. The powder was passed through a mesh having an opening of 38 μm to remove coarse particles. Thus, a toner Jonto which hydrophobic fine powders were externally added was prepared.

The properties of each toner are shown in Table 1.

Each 7 parts of the toners A to J and 100 parts of the above-mentioned magnetic carrier were uniformly mixed and charged by a Turbula Mixer to prepare a developer.

The developer was filled in an image forming apparatus IPSio Color 8100 from Ricoh Company, Ltd. to produce images. The images were evaluated according to the following evaluation standards. The results are shown in Table 2.

Image Density (ID)

A solid image having a toner adherence amount of 0.3±0.1 mg/cm$^2$ was produced on a plain transfer paper TYPE 6200 from Ricoh Company, Ltd., and the image density thereof was measured by X-Rite from X-Rite, Inc. The evaluation was based on the following standard.

○: 1.4 or more

X: less than 1.4

Cleanability (CL)

A residual toner on a photoreceptor just before cleaned was transferred with a Scotch Tape from Sumitomo 3M Ltd. onto a white paper after 1,000 copies of an image chat having an image area of 95% were produced. The Density of the white paper was measured by Macbeth reflection densitometer RD514. The evaluation was based on the following standard.

◎: difference with blank less than 0.005

○: difference with blank of from 0.05 to less than 0.010

Δ: difference with blank of from 0.011 to less than 0.02

X: difference with blank more than 0.02

Transferability (TR)

A residual toner on a photoreceptor just before cleaned was transferred with a Scotch Tape from Sumitomo 3M Ltd. onto a white paper after an image chat having an image area of 20% was produced. Density of the white paper was measured by Macbeth reflection densitometer RD514. The evaluation was based on the following standard.

◎: difference with blank less than 0.005

○: difference with blank of from 0.05 to less than 0.010

Δ: difference with blank of from 0.011 to less than 0.02

X: difference with blank more than 0.02

Anti-Filming (AF)

After 1,000 images of a band chart having an image areas of 10%, 75% and 50% were produced, the filming over the developing roller and photoreceptor were visually observed. The evaluation was based on the following standard.

◎: No filming occurred

○: Filming slightly occurred

Δ: Streak-shaped filming occurred

X: Filming wholly occurred

TABLE 1

| | A (% by number) | | | B | |
|---|---|---|---|---|---|
| | 5 to 15 nm | 15 to 40 nm | 80 to 150 nm | 200 nm or more (% by number) | Weight Reduction rate (%) |
| Example 1 | 78.66 | 21.29 | 0.05 | 18 | 0.5 |
| Example 2 | 94.87 | 5.01 | 0.12 | 22 | 0.7 |
| Example 3 | 78.60 | 21.28 | 0.12 | 18 | 0.5 |
| Example 4 | 85.66 | 14.20 | 0.14 | 18 | 0.5 |
| Example 5 | 83.04 | 16.86 | 0.10 | 22 | 0.7 |
| Comparative Example 1 | 78.57 | 21.27 | 0.16 | 13 | 6 |
| Comparative Example 2 | 78.08 | 21.14 | 0.79 | 8 | 0.8 |
| Comparative Example 3 | 78.66 | 21.29 | 0.05 | 41 | 7 |
| Comparative Example 4 | 99.84 | 0.00 | 0.16 | 18 | 0.5 |
| Comparative Example 5 | 78.70 | 21.30 | 0.00 | — | — |

A: Particle diameter distribution of external additive in a toner

B: External additive having an average particle diameter of from 80 to 150 nm

TABLE 2

| | ID | CL | TR | AF |
|---|---|---|---|---|
| Example 1 | ○ | ○ | ○ | ◎ |
| Example 2 | ○ | ○ | ○ | ◎ |
| Example 3 | ○ | ○ | ○ | ◎ |
| Example 4 | ○ | ◎ | ◎ | ○ |
| Example 5 | ○ | ◎ | ◎ | ○ |
| Comparative Example 1 | ○ | ○ | ○ | X |
| Comparative Example 2 | ○ | X | ○ | ○ |
| Comparative Example 3 | ○ | ◎ | Δ | X |
| Comparative Example 4 | X | ○ | Δ | ○ |
| Comparative Example 5 | ○ | X | X | ○ |

This application claims priority and contains subject matter related to Japanese Patent Application No. 2007-071442 filed on Mar. 19, 2007, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

(A) a parent particulate material, comprising:

(a1) a colorant, and (a2) a binder resin; and (B1) from 0.03 to 2% by number of a first external additive, comprising particles having an average primary particle diameter not less than 80 and less than 150 nm;

(B2) from 50 to 95% by number of a second external additive, comprising particles having an average primary particle diameter not less than 5 nm and less than 15 nm; and (B3) from 5 to 40% by number of a third external additive, comprising particles having an average primary particle diameter not less than 15 and less than 40 nm, wherein the particles of the first external additive (B1) comprise from 10 to 30% by number of particles (b 1.1)

having a particle diameter not less than 200 nm, based on a total number of particles in the first additive (B1), wherein number percentages for (B1), (B2), and (B3) are based on a total number of particles present in all of (B1), (B2), and (B3), wherein the particles of the first external additive (B1) have a weight reduction rate not greater than 3.00% when heated from 30 to 250° C., and wherein the toner is suitable for developing an electrostatic latent image.

2. The toner of claim 1, wherein the first, second, and third external additive (B1), (B2), and (B3) are at least one member selected from the group consisting of a hydrophobic particulate silica, a hydrophobic particulate titanium oxide, and a hydrophobic particulate alumina.

3. The toner of claim 1, wherein the parent particulate material (A) has a circularity of from 0.92 to 0.98.

4. The toner of claim 1, wherein the toner has a ratio (Dv/Dn) of a volume-average particle diameter (Dv) to a number-average particle diameter (Dn) not greater than 1.25.

5. The toner of claim 1, wherein the binder resin (a2) comprises:

(a2.1) a first binder resin; and (a2.2) a second binder resin.

6. The toner of claim 5, wherein the first binder resin (a2.1) is a resin having a polyester skeleton.

7. The toner of claim 5, wherein the first binder resin (a2.1) is a polyester resin.

8. The toner of claim 7, wherein the polyester resin is an unmodified polyester resin.

9. The toner of claim 1, wherein the second external additive (B2) is comprised in an amount of from 60 to 90% by number.

10. The toner of claim 1, wherein the second external additive (B2) is comprised in an amount of from 70 to 85% by number.

11. The toner of claim 1, wherein the particles (b1.1) having the particle diameter not less than 200 nm, comprised in the first external additive (B1), are comprised in an amount of from 12 to 28% by number.

12. The toner of claim 1, wherein the particles (b1.1) having the particle diameter not less than 200 nm, comprised in the first external additive (B1), are comprised in an amount of from 15 to 25% by number.

13. The toner of claim 1, wherein the weight reduction rate is not greater than 2.00%.

14. The toner of claim 1, wherein the weight reduction rate is not greater than 1.00%.

15. A method of preparing a toner for developing electrostatic latent images, comprising:

mixing the external additives with a parent particulate material such that the external additives adhere to the parent particulate material, wherein the toner is the toner according to claim 1.

16. A method of preparing a toner for developing electrostatic latent images, comprising:

dissolving or dispersing a toner constituent comprising at least the binder resin or a binder resin precursor in an oil phase, wherein the toner is the toner according to claim 1.

17. The method of claim 16, wherein the binder resin precursor is an unmodified polyester resin.

18. A method of preparing a toner for developing electrostatic latent images, comprising:

dissolving or dispersing the binder resin (a2), a binder resin precursor, a compound elongatable or crosslinkable with the binder resin precursor, the colorant (a1), a release agent and a modified layered inorganic mineral in an organic solvent to prepare a solution or a dispersion;

subjecting the solution or a dispersion to at least a crosslinking reaction or an elongation reaction in an aqueous medium; and removing the organic solvent and the aqueous medium, wherein the toner is the toner according to claim 1.

* * * * *